US011470912B2

(12) United States Patent
Hatano et al.

(10) Patent No.: US 11,470,912 B2
(45) Date of Patent: Oct. 18, 2022

(54) SHOE SOLE STRUCTURE WITH REINFORCEMENT DEVICE

(71) Applicant: ASICS Corporation, Hyogo (JP)

(72) Inventors: Genki Hatano, Hyogo (JP); Tatsuya Ishikawa, Hyogo (JP); Takashi Inomata, Hyogo (JP); Seigo Nakaya, Hyogo (JP); Hiroyuki Ogi, Hyogo (JP); Souhei Nagano, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 143 days.

(21) Appl. No.: 16/821,976

(22) Filed: Mar. 17, 2020

(65) Prior Publication Data

US 2020/0214389 A1 Jul. 9, 2020

Related U.S. Application Data

(63) Continuation of application No. PCT/JP2017/036559, filed on Oct. 9, 2017.

(51) Int. Cl.
*A43B 7/1445* (2022.01)
*A43B 7/142* (2022.01)
(Continued)

(52) U.S. Cl.
CPC ..... *A43B 7/1445* (2013.01); *A43B 7/142* (2013.01); *A43B 13/141* (2013.01); *A43B 13/181* (2013.01)

(58) Field of Classification Search
CPC ... A43B 13/141; A43B 13/181; A43B 13/183; A43B 13/127; A43B 23/222; A43B 23/227
See application file for complete search history.

(56) References Cited

U.S. PATENT DOCUMENTS 5,297,349 A * 3/1994 Kilgore ..... A43B 5/00 36/114
D433,213 S * 11/2000 Schuette ..... D2/947
(Continued)

FOREIGN PATENT DOCUMENTS

JP 11-266906 A 10/1999
JP 2000-225002 A 8/2000
(Continued)

OTHER PUBLICATIONS

International Search Report issued in corresponding International Patent Application No. PCT/JP0217/036559, dated Jan. 9, 2018, with English translation.

*Primary Examiner* — Megan E Lynch
(74) *Attorney, Agent, or Firm* — McDermott Will & Emery LLP

(57) ABSTRACT

A reinforcement structure is disposed on a midsole of a shoe. A first bar extends from a first point in a medial side of the midsole to a second point in the medial side of the midsole. The second point is closer to a toe of the shoe than the first point. A second bar extends from a third point in the medial side of the midsole to a fourth point in a lateral side of the midsole. The fourth point being closer to the toe of the shoe than the third point. A third bar extending from a fifth point in the medial side of the midsole to a sixth point in the lateral side of the midsole. The sixth point being closer to the toe of the shoe than the fifth point. The third bar extending further toward the toe of the shoe than the second bar.

17 Claims, 18 Drawing Sheets

(51) Int. Cl.
*A43B 13/14* (2006.01)
*A43B 13/18* (2006.01)

(56) References Cited

U.S. PATENT DOCUMENTS 7,082,702 B2 * 8/2006 Cretinon ..... A43B 13/026 36/107
7,299,567 B2 * 11/2007 Berend ..... A43B 7/142 36/107
8,146,273 B2 4/2012 Sokolowski
9,089,185 B2 * 7/2015 Nishiwaki ..... A43B 13/122
9,615,625 B1 * 4/2017 Huard ..... A43B 13/223
2001/0001907 A1 * 5/2001 Luthi ..... A43B 7/24 36/88
2005/0034328 A1 * 2/2005 Geer ..... A43B 13/10 36/30 R
2006/0137228 A1 * 6/2006 Kubo ..... A43B 13/181 36/103
2008/0289220 A1 * 11/2008 Rivas ..... A43B 13/026 36/88
2010/0122472 A1 * 5/2010 Wilson, III ..... A43B 3/0052 36/88
2011/0138652 A1 * 6/2011 Lucas ..... A43B 5/18 36/28
2015/0196087 A1 * 7/2015 Meschter ..... A43B 13/188 36/25 R
2016/0242499 A1 * 8/2016 Droege ..... A43B 13/181
2017/0245590 A1 * 8/2017 Kohatsu ..... A43B 13/186
2018/0184756 A1 * 7/2018 Bartel ..... A43B 13/223
2019/0216165 A1 * 7/2019 Hedstrom ..... A43B 7/148

FOREIGN PATENT DOCUMENTS

JP 2007-089734 A 4/2007
JP 2007-268087 A 10/2007
JP 2015-204984 A 11/2015
WO 2005/037002 A1 4/2005

* cited by examiner

SHOE SOLE STRUCTURE WITH REINFORCEMENT DEVICE

TECHNICAL FIELD

The present disclosure relates to a shoe sole structure having a reinforcement device.

BACKGROUND

A reinforcement device typically increases the bending stiffness (flexural rigidity) in dorsal flexion of the sole, and contributes to the improvement in the forward push-off force and the jumping force. Various structures are known in the art as reinforcement devices.

SUMMARY

Embodiments detailed herein describe a reinforcement structure disposed on a midsole of a shoe. A first bar extends from a first point in a medial side of the midsole to a second point in the medial side of the midsole. The second point is closer to a toe of the shoe than the first point. A second bar extends from a third point in the medial side of the midsole to a fourth point in a lateral side of the midsole. The fourth point being closer to the toe of the shoe than the third point. A third bar extending from a fifth point in the medial side of the midsole to a sixth point in the lateral side of the midsole. The sixth point being closer to the toe of the shoe than the fifth point. The third bar extends further toward the toe of the shoe than the second bar.

The midsole has a medial edge on the medial side, and a lateral edge on the lateral side. In one embodiment, the first bar has an outer edge that may be disposed at the medial edge of the midsole, and an inner edge opposite to the outer edge. In another embodiment, the first bar has an outer edge, a shape of which may follow a shape of the medial edge of the midsole, and an inner edge opposite to the outer edge.

The second and third bars may substantially be straight and parallel with each other.

The reinforcement structure may further include a fourth bar extending from a seventh point in the lateral side of the midsole to an eighth point in the lateral side of the midsole. The eighth point is closer to the toe of the shoe than the seventh point.

The first distance between the first point and the second point may be longer than a second distance between the seventh point and the eighth point.

The midsole has a medial edge on the medial side, and a lateral edge on the lateral side. In one embodiment, the fourth bar may be disposed closer to the lateral edge of the midsole than a center between the medial edge and the lateral edge. In another embodiment, the fourth bar has an outer edge that may be disposed at the lateral edge of the midsole, and an inner edge opposite to the outer edge. In yet another embodiment, the fourth bar has an outer edge, a shape of which may follow a shape of the lateral edge of the midsole, and an inner edge opposite to the outer edge.

In one embodiment, the first bar, the second bar, and the third bar are respectively parts of a single piece, the third point of the second bar is directly connected to the first point of the first bar, and the fifth point of the third bar is directly connected to a seventh point of the first bar. The seventh point is between the first point and the second point.

In another embodiment, the first bar, the second bar, the third bar, and the fourth bar are respectively parts of a single piece, the third point of the second bar is directly connected to the first point of the first bar, the fifth point of the third bar is directly connected to a ninth point of the first bar. The ninth point is between the first point and the second point. The eighth point of the fourth bar is directly connected to the fourth point of the second bar.

The reinforcement structure may further include a fifth bar extending, between the second bar and the third bar, from a tenth point in the medial side of the midsole to an eleventh point in the lateral side of the midsole. The eleventh point is closer to the toe of the shoe than the tenth point. The fifth bar is a part of the single piece together with the first bar, the second bar, the third bar, and the fourth bar. The tenth point of the fifth bar is directly connected to a twelfth point of the first bar. The twelfth point is between the first point and the ninth point.

The reinforcement structure may further include a first gap between the second bar and the fifth bar from which the midsole is exposed; and a second gap between the fifth bar and the third bar from which the midsole is exposed.

A sum of a width of the second bar, a width of the third bar, and a width of the fifth bar is substantially greater than a sum of a width of the first gap and a width of the second gap.

The fifth bar may have an arched shape toward an inside of the midsole.

The second bar has one of a ridge or a groove extending between the third point and the fourth point. The third bar has one of a ridge or a groove extends between the fifth point and the sixth point.

In another aspect, a shoe sole includes a midsole having a surface; the reinforcement structure disposed on the surface of the midsole; and an outsole partially disposed on the surface of the midsole. The reinforcement structure is partially exposed from an area where no outsole is disposed on the midsole.

The first bar, the second bar, and the third bar respectively may have portions disposed under the outsole. The portions have thicknesses thinner than other portions of the first bar, the second bar, and the third bar.

First and second portions of the first bar around the first and second points, respectively, are thinner than another portion of the first bar, third and fourth portions of the second bar around the third and fourth points, respectively, are thinner than another portion of the second bar, fifth and sixth portions of the third bar around the fifth and sixth points, respectively, are thinner than another portion of the third bar, and seventh and eighth portions of the fourth bar around the seventh and eighth points, respectively, are thinner than another portion of the fourth bar.

In yet another aspect, a shoe sole may include: a midsole having a surface; the reinforcement structure disposed on the surface of the midsole; and an outsole partially disposed on the surface of the midsole. The reinforcement structure is partially exposed from an area where no outsole is disposed on the midsole. The first to eighth portions of the first to fourth bars are disposed between the midsole and the outsole.

Additional aspects and advantages of the present disclosure will become readily apparent to those skilled in the art from the following detailed description, wherein only exemplary embodiments of the present disclosure is shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

DESCRIPTION OF THE DRAWINGS

Examples of the subject matter claimed herein are illustrated in the figures of the accompanying drawings and in which reference numerals refer to similar elements.

In FIG. 1, FIG. 2, FIG. 4 and FIG. 5, the thin portions are lightly shaded with large dots. The reinforcement device portions that are exposed on the bottom surface of the shoe sole in FIG. 6 are darkly shaded with fine dots.

In FIG. 7, FIG. 8, FIG. 10 and FIG. 11, the thin portions are lightly shaded with large dots. The reinforcement device portions that are exposed on the bottom surface of the shoe sole in FIG. 12 are darkly shaded with fine dots.

In FIG. 13A and FIG. 13B, the thin portions are lightly shaded with large dots, and the thick portion is darkly shaded with fine dots.

In FIG. 14, the thin portions are lightly shaded with large dots. In FIG. 15, the reinforcement device portions that are exposed on the bottom surface of the sole are darkly shaded with fine dots. In FIGS. 16A to 16D and FIGS. 17A to 17E, the reinforcement devices are shaded with dots.

DESCRIPTION OF THE EMBODIMENT

The present embodiment will now be described below.

In sports such as those using a ball, the abilities to accelerate and to change the direction are more required than the running speed. For example, these abilities manifest in the form of agility during a movement such as a cutting maneuver of rapidly moving in the opposite direction after making an action. The present embodiment provides a shoe sole structure with which it is possible to improve the agility by means of the reinforcement device.

Figure 18A:
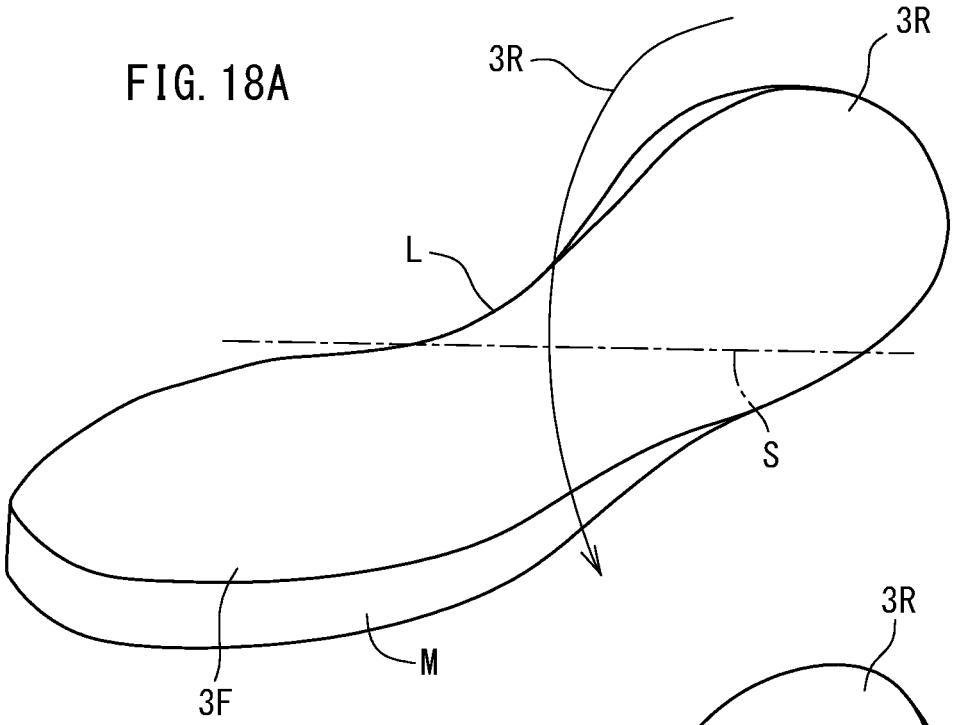
FIGS. 18A and 18B are perspective views showing a midsole being deformed in internal torsion and being deformed in dorsal flexion, respectively, as seen from a diagonal upper-medial direction.
Figure 18B:
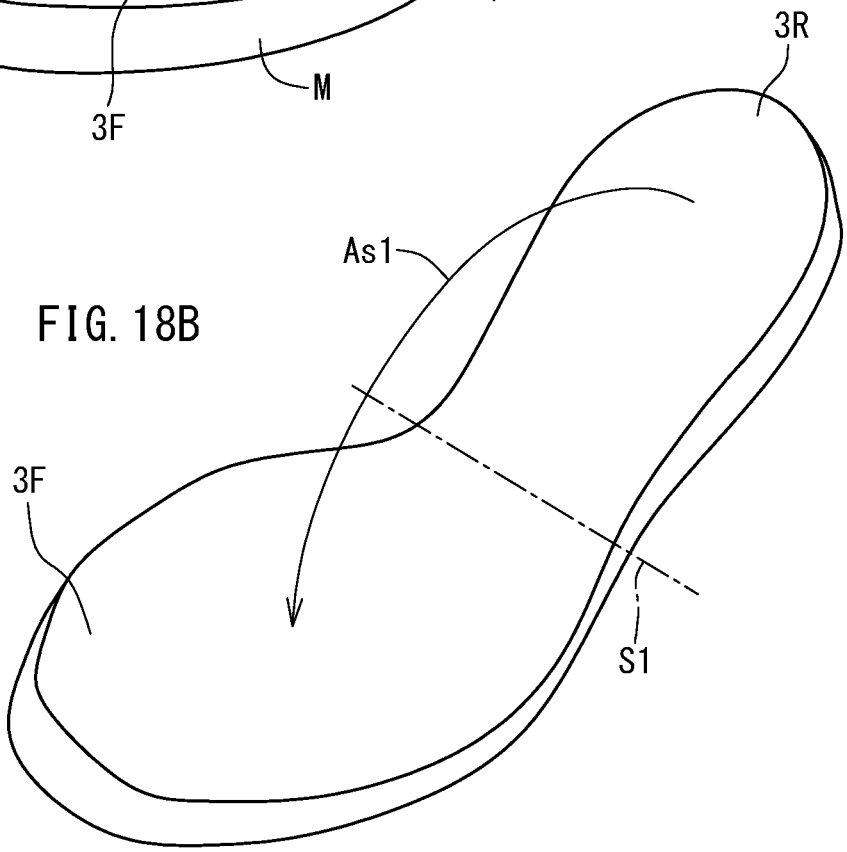

FIG. 18B is a perspective view of a sole as seen from an upper-medial direction, schematically showing a dorsal flexion (dorsal deformation) that occurs during a run, or the like. As indicated by an arrow As1 in the figure, during a dorsal flexion of the sole, a rear foot portion 3R of the sole bends with respect to a forefoot portion 3F about the central axis S1 of dorsal flexion. That is, during a dorsal flexion that occurs during a running action, or the like, the sole bends about the central axis S1, which extends in the transverse direction of the sole.

FIG. 18A is a perspective view of the sole as seen from an upper-medial direction, schematically showing a deformation in internal torsion (medial twist) that occurs during a cutting maneuver described above. As indicated by an arrow As in the figure, the rear foot portion 3R of the sole is pronated with respect to the forefoot portion 3F about the central axis S of twist.

That is, in FIG. 18A, the central axis S is such that the lateral side L of the rear foot portion 3R is twisted toward the medial side M of the forefoot portion 3F. The central axis S of twist extends in a diagonal direction from the medial side M of the rear foot portion 3R toward the lateral side L of the forefoot portion 3F.

As described above, the deformation in internal torsion of FIG. 18A is significantly different from the deformation in dorsal flexion of FIG. 18B.

As a result of basic experiments on the cutting maneuver, it has been found that an increase in the internal torsion of the sole tends to increase the impulse of brake during a cut, thereby improving the performance. Therefore, a high performance in cutting maneuvers can be expected if one attempts not only to increase the bending stiffness against dorsal flexion but also decrease the internal torsion stiffness (medial twist rigidity) about the central axis S of twist.

The present disclosure is directed to a shoe sole structure having a reinforcement device. The shoe sole structure includes: an outsole 4 having a tread surface 40 and an upper surface 41 opposite to the tread surface 40; a midsole 3 having a lower surface 3S attached to the upper surface 41 of the outsole 4; and a reinforcement device 1 that is attached to the lower surface 3S of the midsole 3 and that is harder than the midsole 3 and the outsole 4. The midsole 3 includes a forefoot portion 3F, a middle foot portion 30 and a rear foot portion 3R, and includes a medial edge portion 3M, a lateral edge portion 3L and a central portion 3C between the medial edge portion 3M and the lateral edge portion 3L. The reinforcement device 1 is placed in the middle foot portion 30 so as to extend from the medial edge portion 3M to the lateral edge portion 3L. The reinforcement device 1 includes a first longitudinal portion 21, a first bar 11 and a second bar 12 that are seamlessly integral (continuous) together, the first longitudinal portion 21 extending in a front-rear direction Y in the medial edge portion 3M of the middle foot portion 30 (the first longitudinal portion 21 extends from point P1 to point P2), and the first bar 11 and the second bar 12 being parallel (substantially parallel) to each other; the first bar 11 extends from a posterior end portion 21R of the first longitudinal portion 21 diagonally across the central portion 3C in a diagonal anterior Y1 direction toward a lateral side L to the lateral edge portion 3L (the first bar 11 extends from point P3 to point P4); and the second bar 12 is spaced apart from the first bar, extending from a position that is anterior Y1 to the posterior end portion 21R of the first longitudinal portion 21 diagonally across the central portion 3C in the diagonal anterior direction toward the lateral side L to the lateral edge portion 3L (the second bar 12 extends from point P5 to point P6). Point P1 of the first longitudinal portion is connected with point P3 of the first bar 11. Point P5 of the second bar is connected with point 9 of the first longitudinal portion 21.

In the present disclosure, the first and second bars 11 and 12, which are spaced apart from each other, extend from the first longitudinal portion 21 diagonally across the central portion 3C in a diagonal anterior Y1 direction toward the lateral side L to the lateral edge portion 3L. That is, the two bars 11 and 12 extend diagonally along the central axis S of twist.

Thus, the area of the midsole 3 between the first bar 11 and the second bar 12 is not reinforced and is easily deformable. Therefore, the internal torsion stiffness decreases, and the middle foot portion 30 of the midsole 3 will be allowed to easily twist about the central axis S of twist.

As a result, as the internal torsion increases, the impulse of brake during a cut, or the like, increases, and an improvement to the performance can be expected.

On the other hand, placing the bars diagonally may possibly decrease the bending stiffness against dorsal flexion, which is provided by the bars. In the present disclosure, however, since there are two bars spaced apart from each other in the front-rear direction Y, it will be possible to prevent a decrease in bending stiffness.

Particularly, since the first longitudinal portion 21 is provided in the medial edge portion 3M of the middle foot portion 30, where a large bending load (flexural load) is applied upon dorsal flexion, it is possible to decrease the internal torsion stiffness without so much decreasing the bending stiffness.

Thus, the internal torsion stiffness decreases, and it is possible to increase the impulse of brake during a cut, or the like, through an increase in the internal torsion described above. On the other hand, since the bending stiffness is maintained, there is only a small loss in power transmission from the foot to the sole upon dorsal flexion when sprinting, and it is possible to maintain the sprinting efficiency. As a result, one can expect to be able to perform a cutting maneuver quickly.

In the present disclosure, the term "hard (harder)" means that the reinforcement device 1 is formed from a material having a greater Young's modulus than the midsole 3 and the outsole 4, e.g., a non-foamed hard thermoplastic resin, and that the outsole 4 is not included in the reinforcement device 1.

Note that the Young's moduli between different materials may be compared with each other in terms of the value (hardness) as measured by a durometer.

The forefoot portion 3F, the middle foot portion 30 and the rear foot portion 3R of the midsole 3 refer to areas that cover the forefoot section, the middle foot section and the rear foot section, respectively. The forefoot section includes five metatarsal bones, and fourteen phalanges. The middle foot section includes a navicular bone, a cuboid bone, and three cuneiform bones. The rear foot section includes a talus bone and a calcaneal bone.

The terms "medial edge portion 3M, lateral edge portion 3L and central portion 3C" respectively mean a medial portion, a lateral portion and a portion that is between the medial portion and the lateral portion, which are obtained by dividing the midsole 3 in the transverse direction into three equal parts.

The phrase "the reinforcement device 1 being placed so as to extend from the medial edge portion 3M to the lateral edge portion 3L" means that the reinforcement device 1 is placed so as to extend between at least a part of the medial edge portion 3M and at least a part of the lateral edge portion 3L.

The phrase "the first longitudinal portion 21 extending in the front-rear direction Y in the medial edge portion 3M" means that the area of the first longitudinal portion 21 placed in the region of the medial edge portion 3M extends in the front-rear direction Y, and at least the majority (more than half) of the first longitudinal portion 21 is placed in the medial edge portion 3M but not in the central portion 3C.

Note that the phrase "extending in the front-rear direction Y" includes "extending diagonally anterior Y1."

The phrase "parallel (substantially parallel) to each other" not only includes the case where the elements are geometrically perfectly parallel to each other, but also means that the first bar 11 and the second bar 12 are apart from (parallel to) each other, and the first bar 11 and the second bar 12 extend (next to each other) in substantially the same direction, i.e., in the diagonally anterior Y1 direction.

The phrase "seamlessly integral" means that elements of the reinforcement device 1, such as the first longitudinal portion 21, the first bar 11 and the second bar 12, are formed as a single part. That is, the reinforcement device 1 being a single part includes the first longitudinal portion 21, the first bar 11, the second bar 12, etc.

The phrase "the posterior end portion 21R of the first longitudinal portion 21" means the posterior one of the two equal parts into which the first longitudinal portion 21 is divided in the front-rear direction Y, preferably, the posterior one of the three equal parts into which the first longitudinal portion 21 is divided in the front-rear direction Y. The phrase "from the posterior end portion 21R of the first longitudinal portion 21" means that the posterior end of the first bar 11 is continuous with at least a part of the posterior end portion 21R.

The phrase "a bar extending to the lateral edge portion 3L" means that the bar extends diagonally across the central portion 3C to reach a part of the lateral edge portion 3L, and also includes the case where at least one of the bars extends completely across the midsole 3.

The phrase "being spaced apart" not only includes the case where the bars are connected together only via the first longitudinal portion 21, but also includes the case where the bars are connected together via portions thereof, e.g., where the distal ends of the bars are connected together but with a notch defined between the bars.

Preferably, the reinforcement device 1 includes a second longitudinal portion 22 that is seamlessly integral with the first bar 11, the second longitudinal portion 22 extending in the front-rear direction Y in the lateral edge portion 3L of the middle foot portion 30 (the second longitudinal portion 22 extends from point P7 and point P8); the first bar 11 extends from the posterior end portion 21R of the first longitudinal portion 21 in the diagonal anterior Y1 direction toward the lateral side L to an anterior end portion 22F of the second longitudinal portion 22, thus connecting together the posterior end portion 21R of the first longitudinal portion 21 and the anterior end portion 22F of the second longitudinal portion 22; and the second bar is placed anterior Y1 to the first bar 11 (point P8 of the second longitudinal portion 22 is connected with point P4 of the first bar 11).

In this case, not only the first longitudinal portion 21 is provided in the medial edge portion 3M of the middle foot portion 30, but also the second longitudinal portion 22 extending in the front-rear direction Y is provided in the lateral edge portion 3L. Therefore, the sole has a high bending stiffness, and when there is a large bending load upon dorsal flexion, there will be only a small loss in power transmission from the foot to the sole upon dorsal flexion.

On the other hand, the first bar 11 extending in a diagonally anterior Y1 direction is connected to the first longitudinal portion 21 and the second longitudinal portion 22. This will increase the internal torsion stiffness of the first bar 11 itself. Therefore, the position of the central axis of internal torsion comes closer to the first bar 11, and a stable internal torsion phenomenon will be exhibited about this central axis.

Thus, even if the internal torsion stiffness of the first bar 11 itself increases, since the first bar 11 is placed close to the central axis of internal torsion, it is possible to decrease the internal torsion stiffness of the shoe sole as a whole.

The phrase "the anterior end portion 22F of the second longitudinal portion 22" means the anterior one of the two equal parts into which the second longitudinal portion 22 is divided in the front-rear direction Y, preferably the anterior one of the three equal parts into which the second longitudinal portion 22 is divided in the front-rear direction Y. The phrase "the first bar 11 extending from the posterior end portion 21R of the first longitudinal portion 21 to the anterior end portion 22F of the second longitudinal portion 22" means that the posterior end of the first bar 11 is continuous with at least a part of the posterior end portion 21R, and the anterior end of the first bar 11 is continuous with at least a part of the anterior end portion 22F.

Preferably, the reinforcement device 1 includes a third bar 13 that is seamlessly integral with the first longitudinal portion 21; the third bar 13 is placed between the first bar 11 and the second bar 12; and the third bar 13 is spaced apart from the first and second bars 11 and 12 in the front-rear direction Y, extending from the first longitudinal portion 21 diagonally across the central portion 3C in a diagonal anterior Y1 direction toward the lateral side L to the lateral edge portion 3L (the third bar 13 extends from point P10 to point P11). Point 10 of the third bar 13 is connected with point 12 of the first longitudinal portion 21.

In this case, three bars 11 to 13, spaced apart from each other, each extend from the first longitudinal portion 21 diagonally across the central portion 3C in a diagonal anterior Y1 direction toward the lateral side L to the lateral edge portion 3L. That is, the three bars 11 to 13 extend diagonally along the central axis S of internal torsion.

Since the bars 11 to 13 are spaced apart from each other, the area of the midsole 3 that is between the bars is not reinforced and is easily deformable. Therefore, the internal torsion stiffness of the sole decreases, and the middle foot portion 30 of the midsole 3 will be allowed to easily twist about the central axis S of internal torsion.

As a result, as the internal torsion increases, the impulse of brake during a cut, or the like, increases, and an improvement to the performance can be expected.

On the other hand, placing the bars diagonally may possibly decrease the bending stiffness against dorsal flexion, which is provided by the bars. In the present disclosure, however, since there are three bars spaced apart from each other in the front-rear direction Y, it will be possible to prevent a decrease in bending stiffness. Thus, there will be only a small loss in power transmission from the foot to the sole upon dorsal flexion.

Preferably, an anterior edge 11*f* of the first bar 11 and a posterior edge 13*r* of the third bar 13 together define a first notch (slit) N1 of the reinforcement device 1, wherein the lower surface of the midsole 3 is exposed through the first notch N1; and the posterior edge 12*r* of the second bar 12 and an anterior edge 13*f* of the third bar 13 together define a second notch (slit) N2 of the reinforcement device 1, wherein the lower surface 3S of the midsole 3 is exposed through the second notch N2.

The midsole 3 is exposed in the areas of the first and second notches N1 and N2, and the internal torsion stiffness will be reduced in these notches N1 and N2. Therefore, the shoe sole will be allowed to easily twist.

Note that regarding the exposure of the lower surface of the midsole 3 through the notches, it is only required that the lower surface 3S of the midsole 3 be exposed at least partially through the notches N1 and N2, and it may be partially covered by the outsole 4.

Preferably, the first and second notches N1 and N2 extend diagonally at least across more than half (a majority) of the central portion 3C, and further extend in the diagonal anterior direction from the central portion 3C to the lateral edge portion 3L.

The notches extend diagonally at least across more than half (the majority; more than 50%) of the central portion, and preferably extend diagonally at least across the great majority (80% or more) of the central portion. It is only required that the notches extend essentially across the central portion. Thus, the notches N1 and N2, which extend (cross) diagonally across the central portion 3C will reliably decrease the internal torsion stiffness. Therefore, this will increase the certainty that there is obtained a shoe sole that can be twisted easily.

Note that the notches N1 and N2 may extend from at least a part of the medial edge portion 3M to at least a part of the lateral edge portion 3L.

Preferably, the first and second notches N1 and N2 are each formed in a strip shape and are provided so as to be parallel (substantially parallel) to each other.

When the strip-shaped first and second notches N1 and N2 are substantially parallel to each other, the third bar 13 between the first notch and the second notch is also formed in a strip shape.

The strip-shaped third bar 13 is arranged between the first bar 11 and the second bar 12, and will be placed close to the central axis of internal torsion of the reinforcement device 1. Therefore, the internal torsion deformed state of the shoe sole will be stable, and a stable internal torsion will be achieved during a cut, or the like.

The term "strip shape" means that the width of each of the notches N1 and N2 does not change significantly.

The phrase "parallel (substantially parallel) to each other" not only includes the case where the elements are geometrically parallel to each other, but also means that the first notch and the second notch are apart from (parallel to) each other, and the first notch N1 and the second notch N2 extend (next to each other) in substantially the same diagonally anterior Y1 direction.

Preferably, a sum of widths of the first, second and third bars in the central portion 3C is greater than a sum of widths of the first and second notches in the central portion 3C.

When the sum of the widths of the bars is smaller than the sum of the widths of the notches, the internal torsion stiffness or the bending stiffness may become too small. In contrast, when the sum of the widths of the bars is greater than the sum of the widths of the notches, a high bending stiffness and an intended stiffness of internal torsion will likely be achieved.

The width of a bar or a notch means the width in a direction that is perpendicular to the direction in which a bar or a notch extends.

Preferably, an average width value between the first, second and third bars in the central portion 3C is greater than an average width value between the first and second notches in the central portion 3C.

In this case, a high bending stiffness and an intended stiffness of internal torsion will be even more likely achieved. Moreover, the deformation in internal torsion will be stable.

The "average width value between the first, second and third bars" means a value that is obtained by dividing the sum of the widths of n bars by n, for example, and the "average width value between the first and second notches" means a value that is obtained by dividing the sum of the widths of m notches by m.

Preferably, the midsole 3 has an upper surface 31 opposite to the lower surface; and the third bar 13 is formed in an arch shape that is convex (protruding) toward the upper surface 31 of the midsole 3.

Since the third bar, placed between the first bar and the second bar, is formed in an arch shape protruding toward the upper surface 31, the third bar, even if it is thin, will prevent the lowering of the arch of the foot.

Preferably, thin portions 17 sandwiched between the midsole 3 and the outsole 4, the thin portions 17 including respective distal end (tip) portions E of the first, second and third bars; an anterior end portion 21F of the first longitudinal portion 21; and the posterior end portion 21R of the first longitudinal portion 21; and a thick portion 18 exposed on the lower surface of the midsole 3, the thick portion 18 being thicker than the thin portions 17.

While the wearer gets the feel of catching the road surface or the ground through the outsole 4, if there is a layer having a high bending stiffness between the outsole 4 and the sole of the foot, it will lower the feel.

Here, since portions of the reinforcement device 1 that are sandwiched between the midsole 3 and the outsole 4 are the thin portions 17, and the thin portions 17 have a low bending stiffness, it will less likely to lower the feel of the wearer.

On the other hand, if the reinforcement device 1 does not have a sufficient thickness in the area where it is not covered by the outsole but is exposed, an intended bending stiffness or internal torsion stiffness will not be achieved.

Here, since the reinforcement device 1 in such an exposed area is the thick portion 18, the stiffness (rigidity) of the thick portion 18 increases, and an intended bending stiffness or internal torsion stiffness will likely be achieved.

Preferably, in the thick portion 18, each of the bars includes a ridge T or a groove G extending along a direction in which the bar extends.

Such a ridge or groove serves to adjust the bending stiffness or the internal torsion stiffness of each bar.

For example, a ridge increases the bending stiffness without so much increasing the internal torsion stiffness. On the other hand, a groove decreases the internal torsion stiffness without so much decreasing the bending stiffness.

Preferably, a distal end portion E of the second bar 12 is a free end portion that is spaced apart from the first and second longitudinal portions 21 and 22.

In this case, the stiffness of the distal end portion E of the second bar 12 is lower than that of the first bar, and therefore the stiffness of the reinforcement device 1 in the forefoot portion will be lower than that in the middle foot portion. Thus, it is possible to prevent an increase in stiffness in the forefoot portion while increasing the stiffness in the middle foot portion.

Preferably, the outsole 4 is continuous from a forefoot section to a rear foot section, and includes a cut-out notch portion N in the middle foot portion of the midsole 3; and at least a portion of the first longitudinal portion 21 and at least a portion of the first and second bars 11 and 12 are exposed through the notch portion N.

With the provision of the notch portion N in the outsole, it is possible to reduce the weight of the shoe sole, and with a part of the reinforcement device 1 being exposed through the notch portion N, an intended bending stiffness and internal torsion stiffness will likely be achieved.

Preferably, the outsole 4 is divided in a front-rear direction into an anterior part 4F and a posterior part 4R; and at least a portion of each of the first longitudinal portion 21, the second longitudinal portion 22 and the first and second bars 11 and 12 is exposed between the anterior part 4F and the posterior part 4R of the outsole 4.

With the outsole divided into an anterior part and a posterior part, it is possible to reduce the weight of the shoe sole, and with a part of the reinforcement device 1 being exposed between the anterior part 4F and the posterior part 4R, an intended bending stiffness and internal torsion stiffness will likely be achieved.

Preferably, an anterior end portion 21F of the first longitudinal portion 21 and the second bar 12 are continuous together in a V-letter shape; and a distal end portion E of the second bar 12 is placed anterior Y1 to the anterior end portion 21F of the first longitudinal portion 21.

The first longitudinal portion 21 supports the arch on the medial foot, and also achieves a high bending stiffness and torsion stiffness (twist rigidity) in the medial edge portion 3M. On the other hand, the distal end portion E of the second bar 12 being placed anterior Y1 to the anterior end portion 21F of the first longitudinal portion 21 and extending to the lateral edge portion 3L will increase the bending stiffness and make it possible to control the torsion stiffness also in the lateral edge portion 3L.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

Embodiments

The present disclosure will be understood more clearly from the following description of examples taken in conjunction with the accompanying drawings. Note however that the embodiments and the drawings are merely illustrative. In the accompanying drawings, like reference numerals denote like components throughout the plurality of figures.

Embodiment 1

Embodiment 1 of the present disclosure will now be described with reference to FIG. 1 to FIG. 6.

Note that the embodiments are directed to shoe soles for ball sports.

Figure 3A:
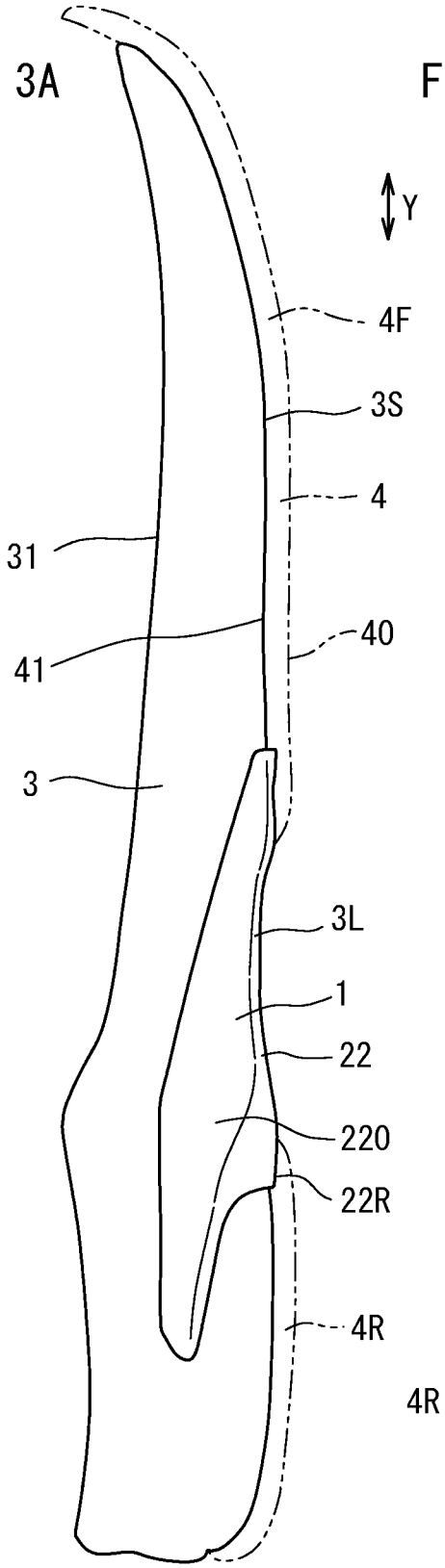
FIG. 3A is a lateral side view thereof.
Figure 3B:
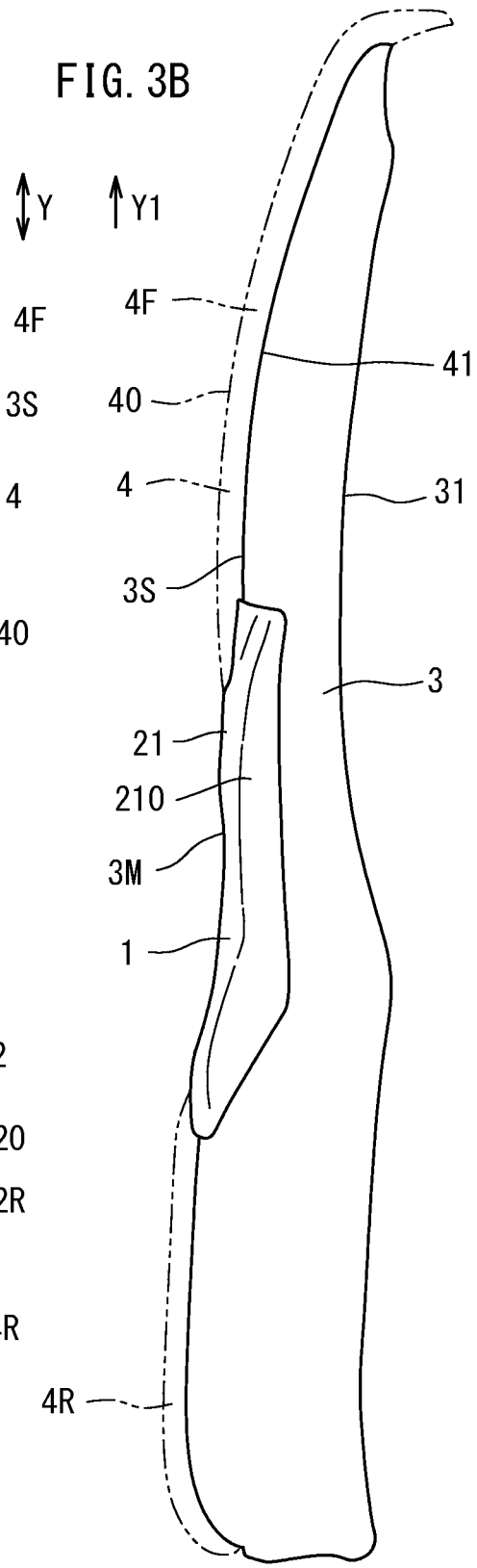
FIG. 3B is a medial side view thereof.

As shown in FIG. 3A and FIG. 3B, the shoe sole includes an outsole 4 made of a rubber, a midsole 3 made of a resin, and a reinforcement device 1 made of a resin. Note that an upper (not shown) covering the instep is provided on the shoe sole.

The midsole 3 includes a midsole body made of a foamed resin such as EVA, for example. Note that "made of resin" means that it contains a resin component such as a thermoplastic component, and it may contain any other suitable component. The midsole 3 may be provided with a low-resilience material, a high-resilience material, a groove, etc.

The outsole 4 is a tread sole having a high abrasion resistance than the foamed material of the midsole body, and typically has a higher hardness than the foamed material of the midsole body. Note that "made of rubber" means that it contains a natural rubber component or a synthetic rubber component, and it may contain any other component.

An insole (not shown) is bonded on the midsole 3. Note that further on the insole, a sock liner (inner sole) may be placed inside the upper.

The outsole 4 has a tread surface 40 to be in contact with the road surface or the ground, and an upper surface 41 on the opposite side. The midsole 3 has a lower surface 3S attached to the upper surface 41 of the outsole 4.

The reinforcement device 1 is attached to the lower surface 3S of the midsole 3. The reinforcement device 1 is formed from a non-foamed material (solid material) of a thermoplastic resin, for example, and is harder than the midsole 3 and the outsole 4.

Figure 1:
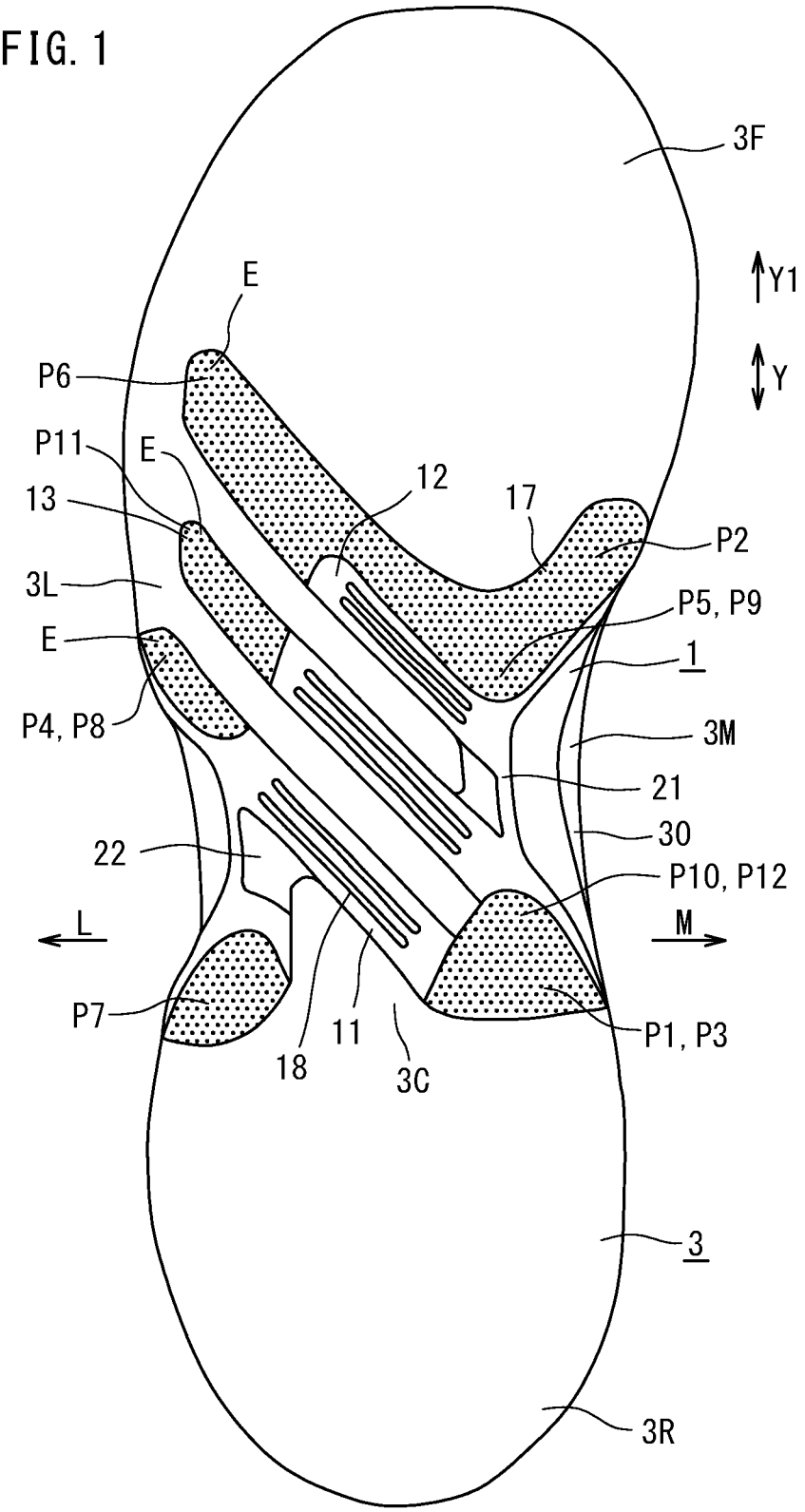
FIG. 1 is a bottom view showing a midsole and a reinforcement device, or a plan view showing the reinforcement device, according to Embodiment 1 of the present disclosure.

In FIG. 1, the midsole 3 includes a forefoot portion 3F, a middle foot portion 30 and a rear foot portion 3R. The midsole 3 includes a medial edge portion 3M, a lateral edge portion 3L, and a central portion 3C between the medial edge portion 3M and the lateral edge portion 3L.

The reinforcement device 1 is placed in the middle foot portion 30 so as to extend from the medial edge portion 3M to the lateral edge portion 3L. The reinforcement device 1 extends from the middle foot portion 30 into the posterior half of the forefoot portion 3F and the anterior end of the rear foot portion 3R.

The reinforcement device 1 includes the first to second longitudinal portions 21 and 22 and the first to third bars 11 to 13 that are seamlessly integral together. The first and second longitudinal portions 21 and 22 respectively include a medial side surface portion 210 and a lateral side surface portion 220 that are seamlessly integral together with respective longitudinal portions as shown in FIG. 3B and FIG. 3A.

The first longitudinal portion 21 extends in the front-rear direction Y in the medial edge portion 3M of the middle foot portion 30. On the other hand, the second longitudinal portion 22 extends in the front-rear direction Y in the lateral edge portion 3L of the middle foot portion 30. Each of the first and second longitudinal portions may extend into the central portion 3C.

Figure 2:
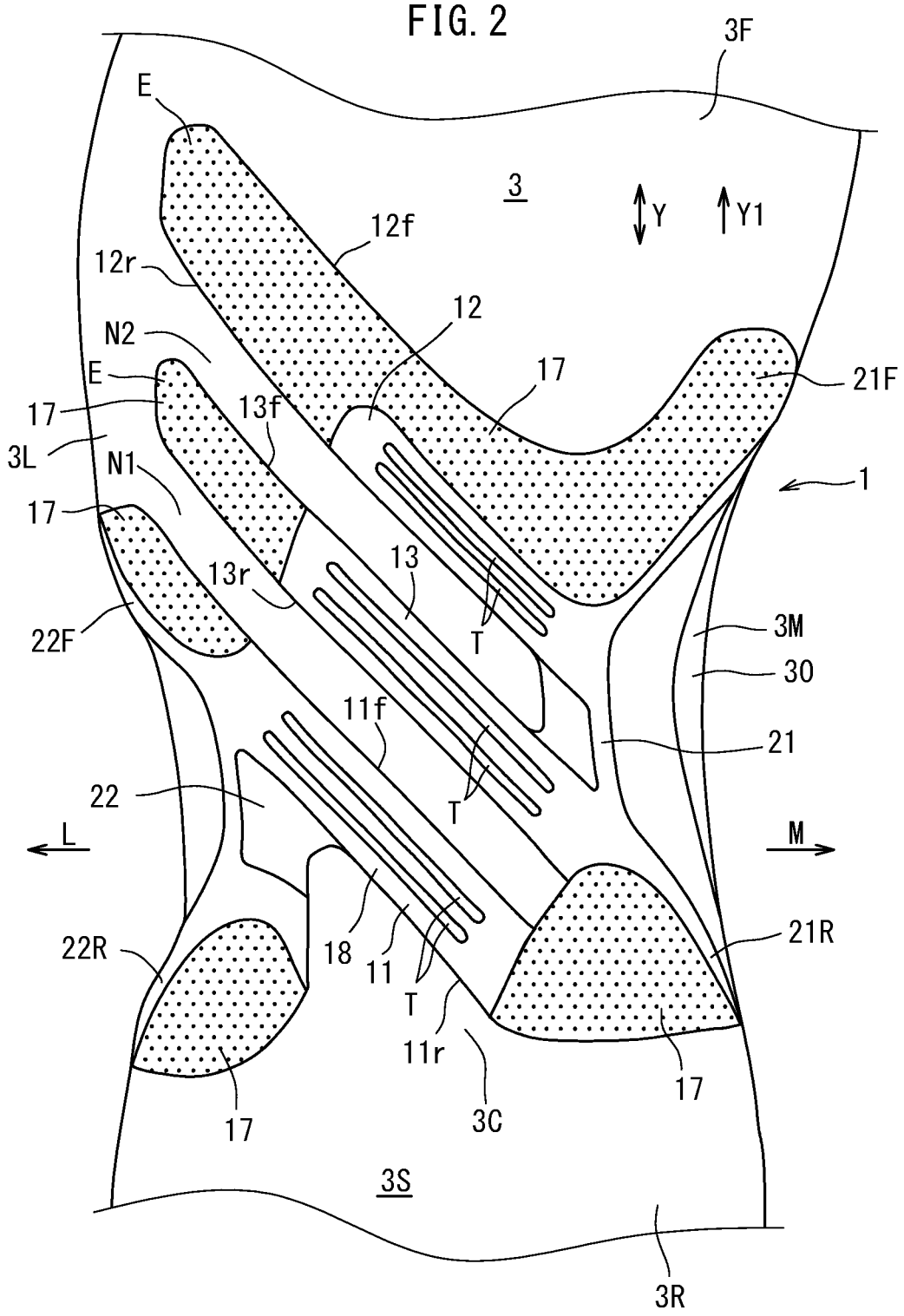
FIG. 2 is an enlarged bottom view showing the same with portions thereof cut away.

In FIG. 2, an anterior end portion 21F of the first longitudinal portion 21 is placed anterior Y1 to an anterior end portion 22F of the second longitudinal portion 22. A posterior end portion 21R of the first longitudinal portion 21 is placed anterior Y1 to a posterior end portion 22R of the second longitudinal portion 22. The length of the first longitudinal portion 21 in the front-rear direction Y is longer than the length of the second longitudinal portion 22 in the front-rear direction Y.

As shown in FIG. 2 and FIG. 3B, the medial side surface portion 210 rolls up from the first longitudinal portion 21 onto the medial side surface of the midsole 3. On the other hand, as shown in FIG. 2 and FIG. 3A, the lateral side surface portion 220 rolls up from the second longitudinal portion 22 onto the lateral side surface of the midsole 3.

The lateral side surface portion 220 of FIG. 3A may extend posterior to the posterior end portion 22R of the second longitudinal portion 22. The medial side surface portion 210 and the lateral side surface portion 220 may extend continuously in the front-rear direction Y, but they may extend from the first longitudinal portion 21 or the second longitudinal portion 22 in a comb-shaped pattern along the side surface of the midsole 3.

The medial side surface portion 210 and the lateral side surface portion 220 may be regarded as being parts of the first longitudinal portion 21 and the second longitudinal portion 22, respectively, or may be regarded as being continuous with the first longitudinal portion 21 and the second longitudinal portion 22, respectively.

In FIG. 2, the first bar 11 extends from the posterior end portion 21R of the first longitudinal portion 21 diagonally across the central portion 3C in a diagonal anterior Y1 direction toward the lateral side L to the lateral edge portion 3L. In the case of this example, the first bar 11 connects together the posterior end portion 21R of the first longitudinal portion 21 and the anterior end portion 22F of the second longitudinal portion 22. That is, the first bar 11 extends from the posterior end portion 21R of the first longitudinal portion 21 in a diagonal anterior Y1 direction toward the lateral side L to the anterior end portion 22F of the second longitudinal portion 22.

In FIG. 2, the second bar 12 is placed anterior Y1 to the first bar 11. The second bar 12 is spaced apart from the first bar 11. The second bar 12 extends from a position of the first longitudinal portion 21, which is anterior Y1 to the posterior end portion 21R of the first longitudinal portion 21, diagonally across the central portion 3C in a diagonal anterior direction toward the lateral side L to the lateral edge portion 3L.

In FIG. 2, the third bar 13 is placed between the first bar 11 and the second bar 12. The third bar 13 is spaced apart from the first and second bars 11 and 12 in the front-rear direction Y. The third bar 13 extends from the first longitudinal portion 21 diagonally across the central portion 3C in a diagonal anterior Y1 direction toward the lateral side L to the lateral edge portion 3L.

Figure 5:
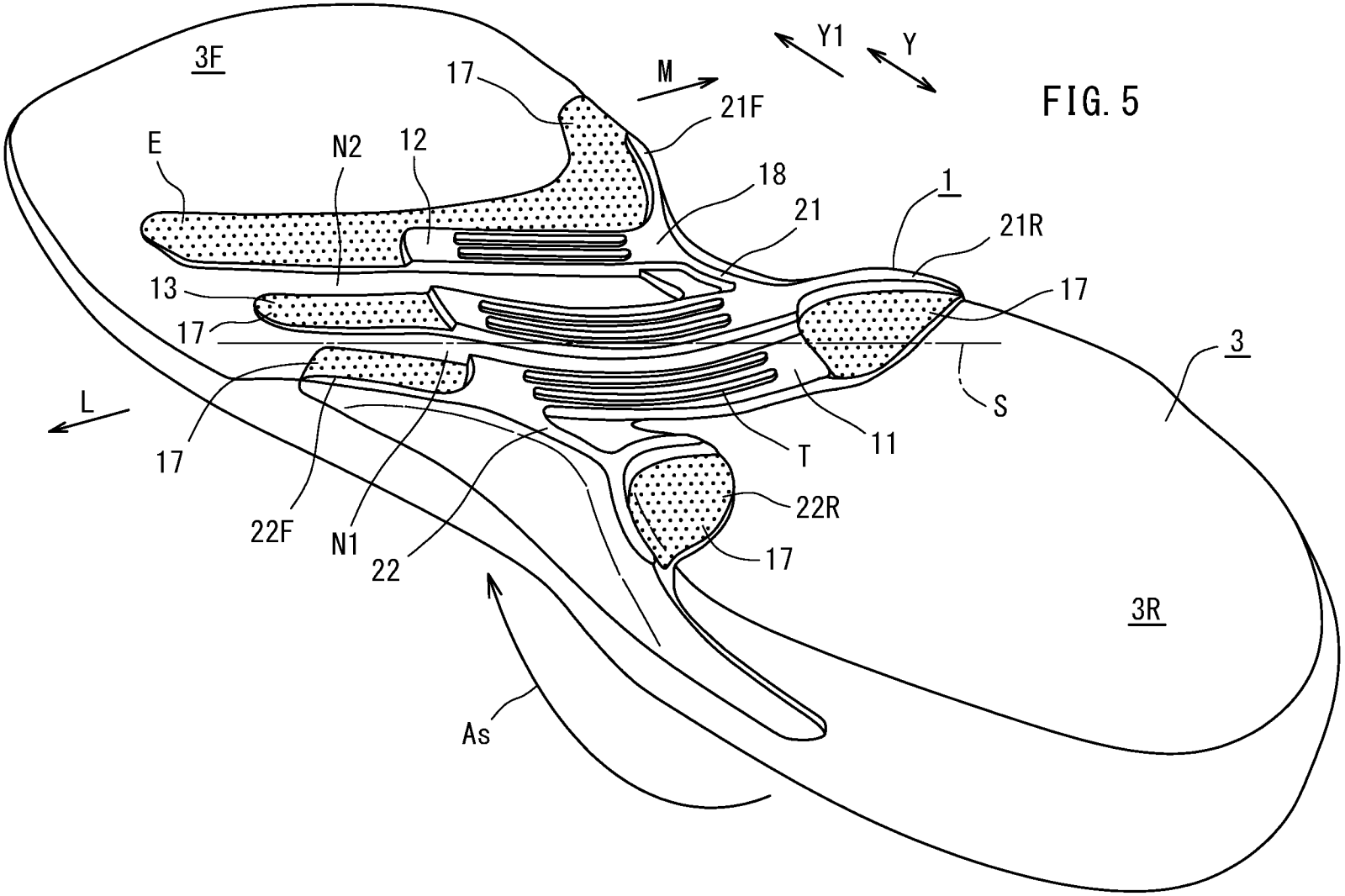
FIG. 5 is a perspective view showing the same as seen from a diagonal posterior-lateral side.

As shown in FIG. 5, the first to third bars 11 to 13 extends in a diagonal direction along the central axis S of internal torsion.

In FIG. 2, the anterior end portion 21F of the first longitudinal portion 21 and the second bar 12 are continuous together in a V-letter shape. The distal end portion E of the second bar 12 is placed anterior Y1 to the anterior end portion 21F of the first longitudinal portion 21.

The distal end portions E of the second bar 12 and the third bar 13 are free end portions that are spaced apart from the first and second longitudinal portions 21 and 22.

In FIG. 3A and FIG. 3B, the midsole 3 includes the upper surface 31 that is opposite to the lower surface 3S. The third bar 13 of FIG. 5 is formed in an arch shape protruding toward the upper surface 31 of the midsole 3. Note that the first bar 11 may also be formed in an arch shape protruding toward the upper surface 31.

In FIG. 2, the anterior edge 11*f* of the first bar 11 and the posterior edge 13*r* of the third bar 13 are spaced apart from each other in the front-rear direction Y, defining the first notch N1 of the reinforcement device 1. The lower surface 3S of the midsole 3 is exposed through the first notch N1.

The posterior edge 12*r* of the second bar 12 and the anterior edge 13*f* of the third bar 13 are spaced apart from each other in the front-rear direction Y, defining the second notch N2 of the reinforcement device 1. The lower surface 3S of the midsole 3 is exposed through the second notch N2.

In FIG. 2, each of the first and second notches N1 and N2 extends from the medial edge portion 3M diagonally across the central portion 3C in a diagonally anterior direction to the lateral edge portion 3L. The first and second notches N1 and N2 are each formed in a strip shape and are provided so as to be substantially parallel to each other.

Figure 4:
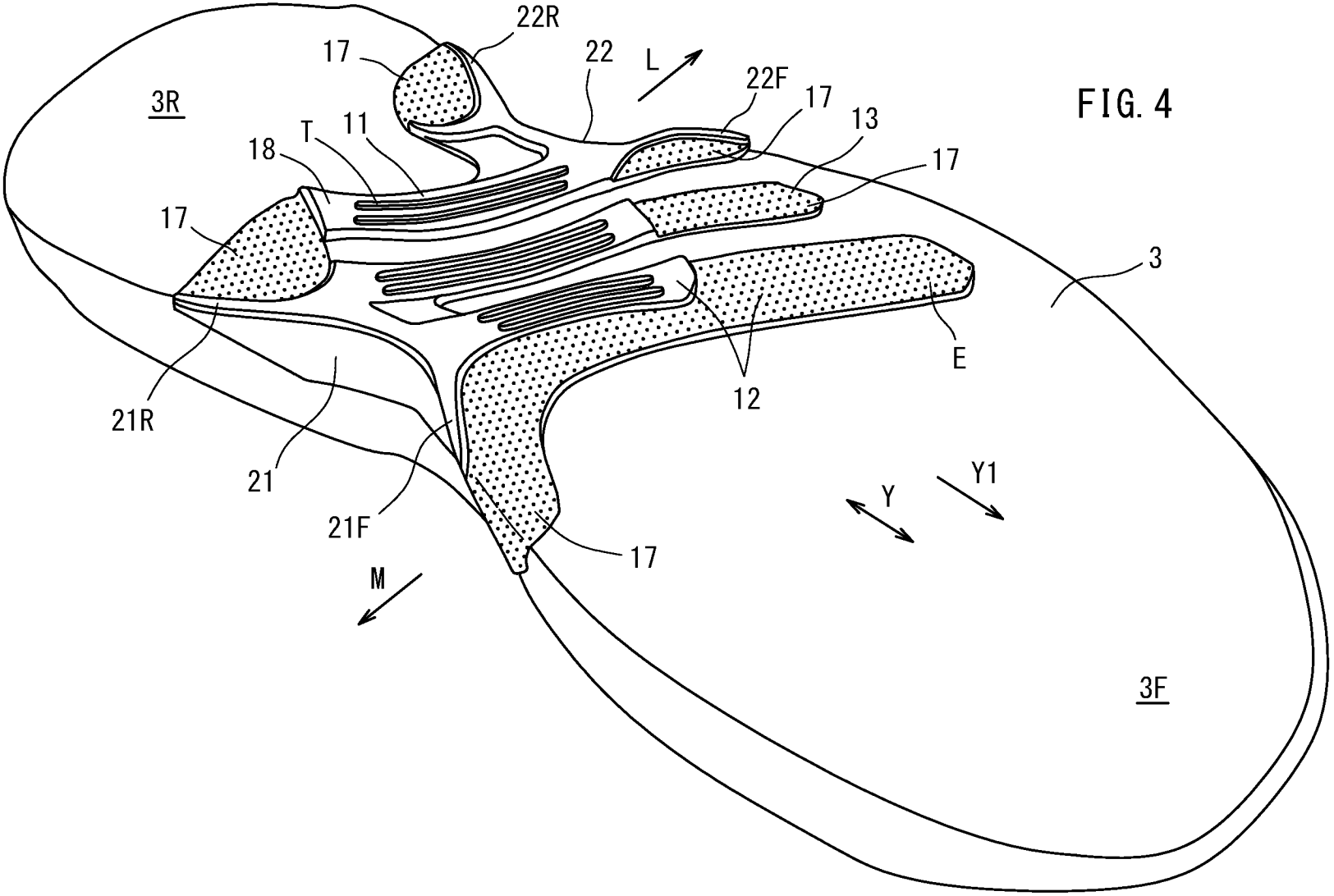
FIG. 4 is a perspective view showing the midsole and the reinforcement device as seen from a diagonal anterior-medial side.

As shown in FIG. 4 and FIG. 5, the reinforcement device 1 includes thin portions 17 and a thick portion 18. The thick portion 18 is thicker than the thin portions 17.

Figure 6:
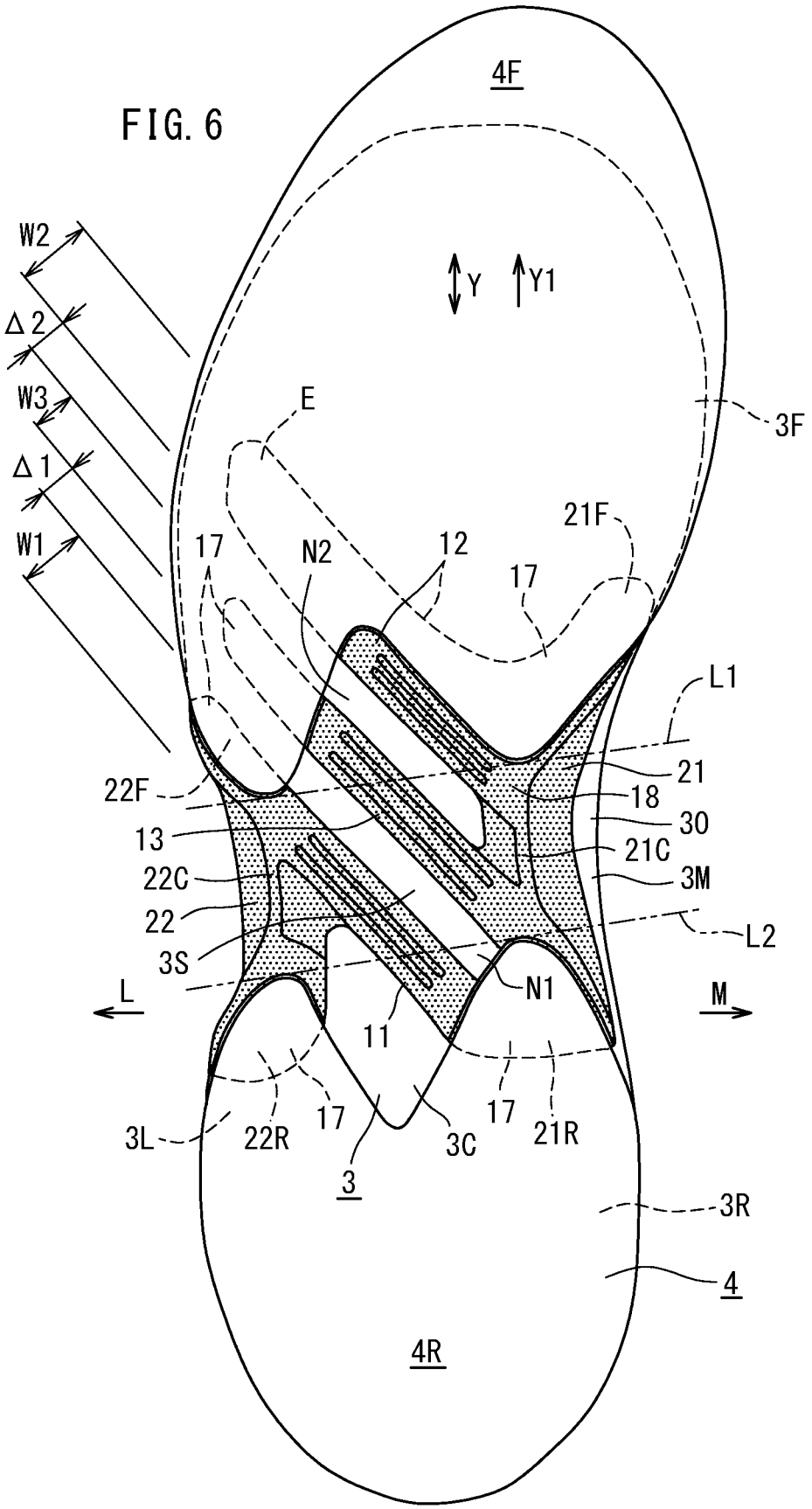
FIG. 6 is a bottom view showing the same shoe sole.

In FIG. 6, the outsole 4 is divided in a front-rear direction into the anterior part 4F and the posterior part 4R. A portion of each of the first longitudinal portion 21, the second longitudinal portion 22 and the first bar to the third bar 11 to 13 is exposed between the anterior part 4F and the posterior part 4R of the outsole 4. The thin portions of the first to third bars 11 to 13 and the anterior end portion 21F of the first longitudinal portion (FIG. 2) are sandwiched between the midsole 3 and the anterior part 4F of the outsole 4. On the other hand, the thin portions of the posterior end portions 21R and 22R of the first and second longitudinal portions (FIG. 2) are sandwiched between the midsole 3 and the posterior part 4R of the outsole 4.

The thick portion 18 is an area that is exposed between the anterior part 4F and the posterior part 4R. That is, the thick portion 18 is exposed on the lower surface 3S of the midsole 3.

The thick portion 18 includes middle portions 21C and 22C of the longitudinal portions 21 and 22, and portions of the first to third bars 11 to 13 that are placed in the central portion 3C.

In FIG. 4 and FIG. 5, the thick portion 18 includes a ridge T for each of the bars described above, the ridge T extending along the direction in which the bar extends.

Note that a groove may be provided on the outsole 4 along the direction in which the ridge T extends.

The more than half (majority) of the area of the midsole 3 where the anterior part 4F and the posterior part 4R are absent constitutes the middle foot portion 30.

In FIG. 6, the virtual first line L1 is a line that connects together the posterior end on the medial side of the anterior part 4F and the posterior end on the lateral side thereof. On the other hand, the virtual second line L2 is a line that connects together the anterior end on the medial side of the posterior part 4R and the anterior end on the lateral side thereof.

The area of the midsole 3 between the virtual first line L1 and the virtual second line L2 does not essentially contact the ground and constitutes the middle foot portion 30.

As indicated by a broken line in FIG. 6, the thin portions 17 are sandwiched between the midsole 3 and the outsole 4. That is, the thin portions 17 include the anterior edge portion of the first bar 11, the distal end portions E of the bars, the anterior end portion 21F of the first longitudinal portion 21, the posterior end portion 21R of the first longitudinal portion 21 and the posterior end portion 22R of the second longitudinal portion 22.

In FIG. 6, designations W1 to W3 denote the average width values of the first to third bars 11 to 13, respectively, in the central portion 3C. On the other hand, designations Δ1 and Δ2 denote the average width values of the first and second notches N1 and N2, respectively, in the central portion 3C.

Note that in this example, areas of the bars 11 to 13 that are placed in the central portion 3C are exposed.

In this example, the sum (W1+W2+W3) of the widths of the bars in the central portion 3C is greater than the sum (Δ1+Δ2) of the widths of the notches in the central portion 3C.

The average width value ((W1+W2+W3)/3) between the bars in the central portion 3C is greater than the average width value ((41+42)/2) between the notches in the central portion 3C.

In FIG. 5, if the midsole 3 exhibits an internal torsion as indicated by the arrow As about the central axis S of internal torsion during a cut, or the like, since the areas of the first notch N1 and the second notch N2 have a low stiffness, an area of the midsole 3 on the lateral side L can be twisted easily. This will increase the impulse of brake.

On the other hand, the first and second longitudinal portions 21 and 22 and the first to third bars 11 to 13 each function as a ridge during a dorsal flexion of FIG. 18(*b*), thereby decreasing the loss in power transmission from the foot to the sole.

Next, an experiment conducted by the present inventors will be described briefly.

First, Test Example 1 and Reference Examples 1 and 2 were provided as shoes used in the experiment.

The shoe of Test Example 1 includes the reinforcement device 1 of Embodiment 1 described above.

The shoe of Reference Example 1 includes an "N-shaped" reinforcement device 1.

Reference Example 2 includes a reinforcement device 1 that covers generally the entire area of the middle foot portion.

These shoes were worn to measure the amount of deformation of the sole during a cutting maneuver and the running speed immediately following a cutting maneuver. As a result of the experiment, it was confirmed that with the shoe of Test Example 1, the twist (deformation) was greater than the reference examples, and it was possible to run faster.

Embodiment 2

FIG. 7 to FIG. 12 show Embodiment 2.

Embodiment 2 will be described below, primarily focusing on its differences from Embodiment 1.

Figure 12:
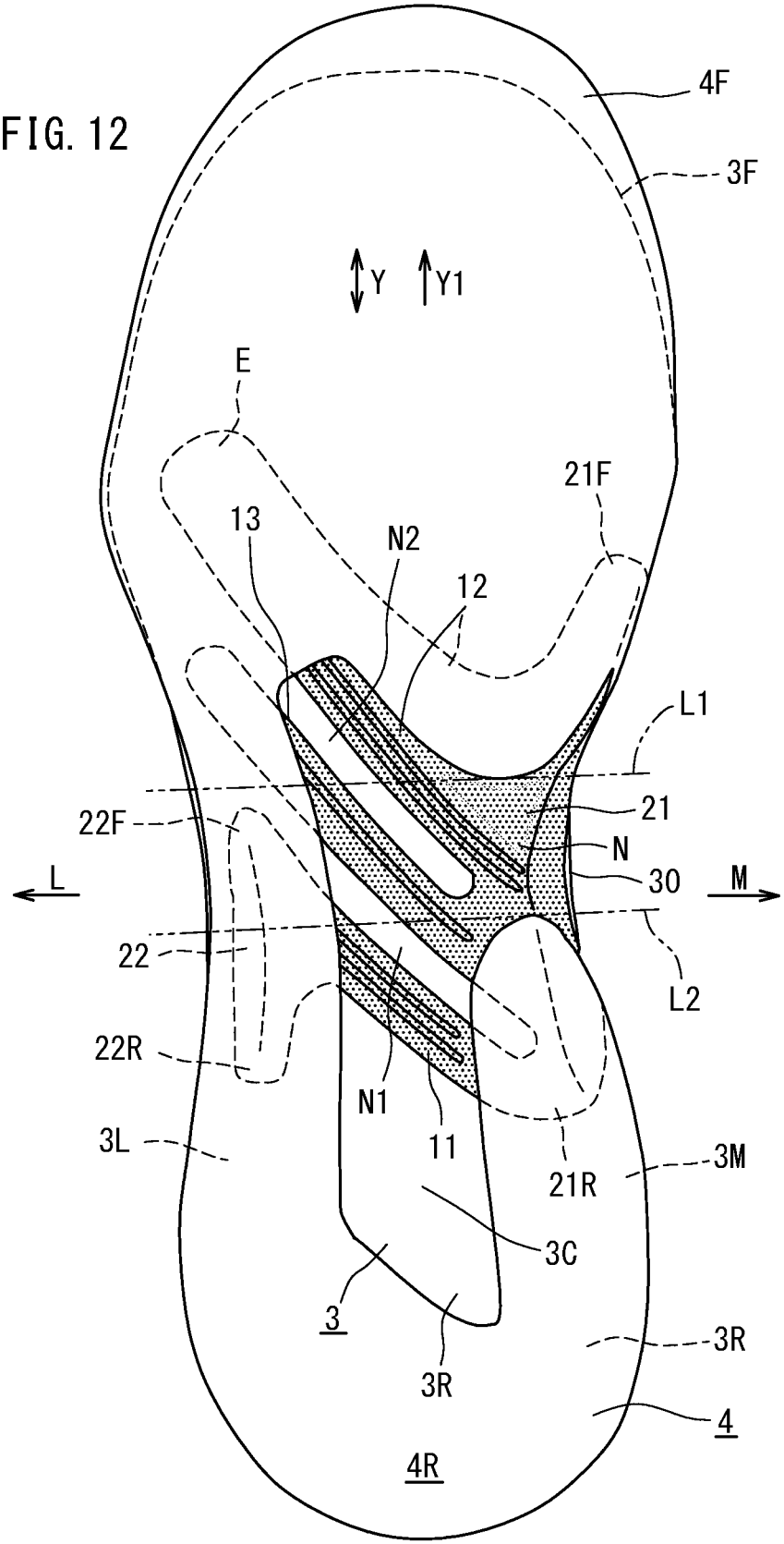
FIG. 12 is a bottom view showing the same shoe sole.

In FIG. 12, the outsole 4 is continuous from the forefoot section to the rear foot section, and includes a cut-out notch portion N in the middle foot portion 30 of the midsole 3. At least a portion of the first longitudinal portion 21 and the first and second bars 11 and 12 are exposed through the notch portion N.

Note that in this example, the notch portion N extends to the central portion 3C of the rear foot portion 3R. The outsole 4 is continuous in the front-rear direction Y along the lateral edge portion 3L of the middle foot portion 30, whereas it is divided in the front-rear direction Y along the medial edge portion 3M of the middle foot portion 30, thus forming a generally C-letter shape.

Figure 9A:
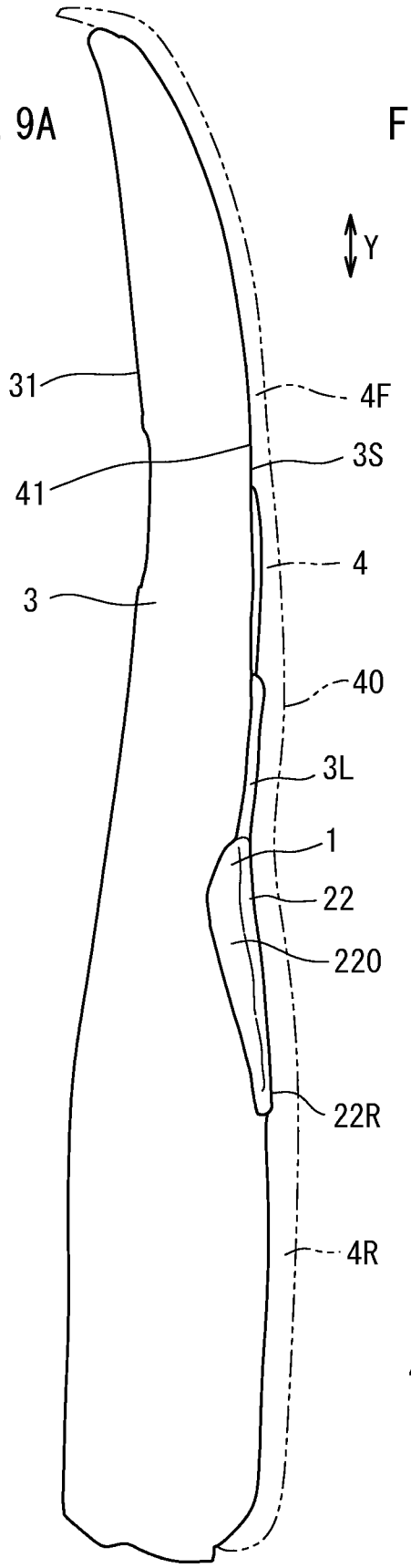
FIG. 9A is a lateral side view thereof.
Figure 9B:
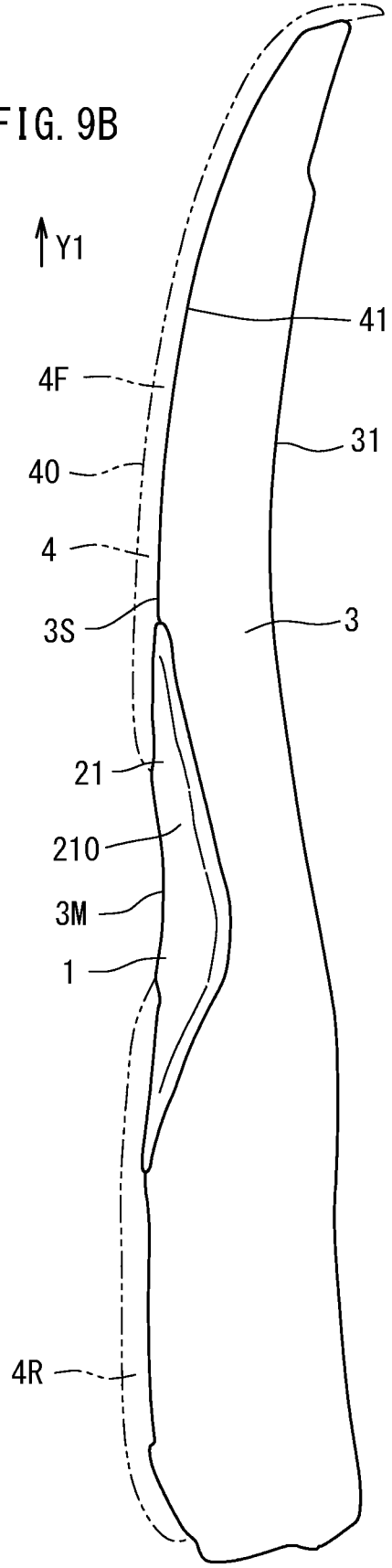
FIG. 9B is a medial side view thereof.

In FIG. 12, the virtual first line L1 is a line that touches the anterior edge of the notch portion N on the medial side. The virtual second line L2 is a line that touches the posterior edge of the notch portion N on the medial side. The area between the two lines L1 and L2 constitutes the middle foot portion 30, where the midsole 3 does not essentially contact the ground (on a flat road surface). Note that in the middle foot portion 30, also the lateral side of the outsole 4 does not essentially contact the ground under no load, as shown in FIG. 9A.

Figure 8:
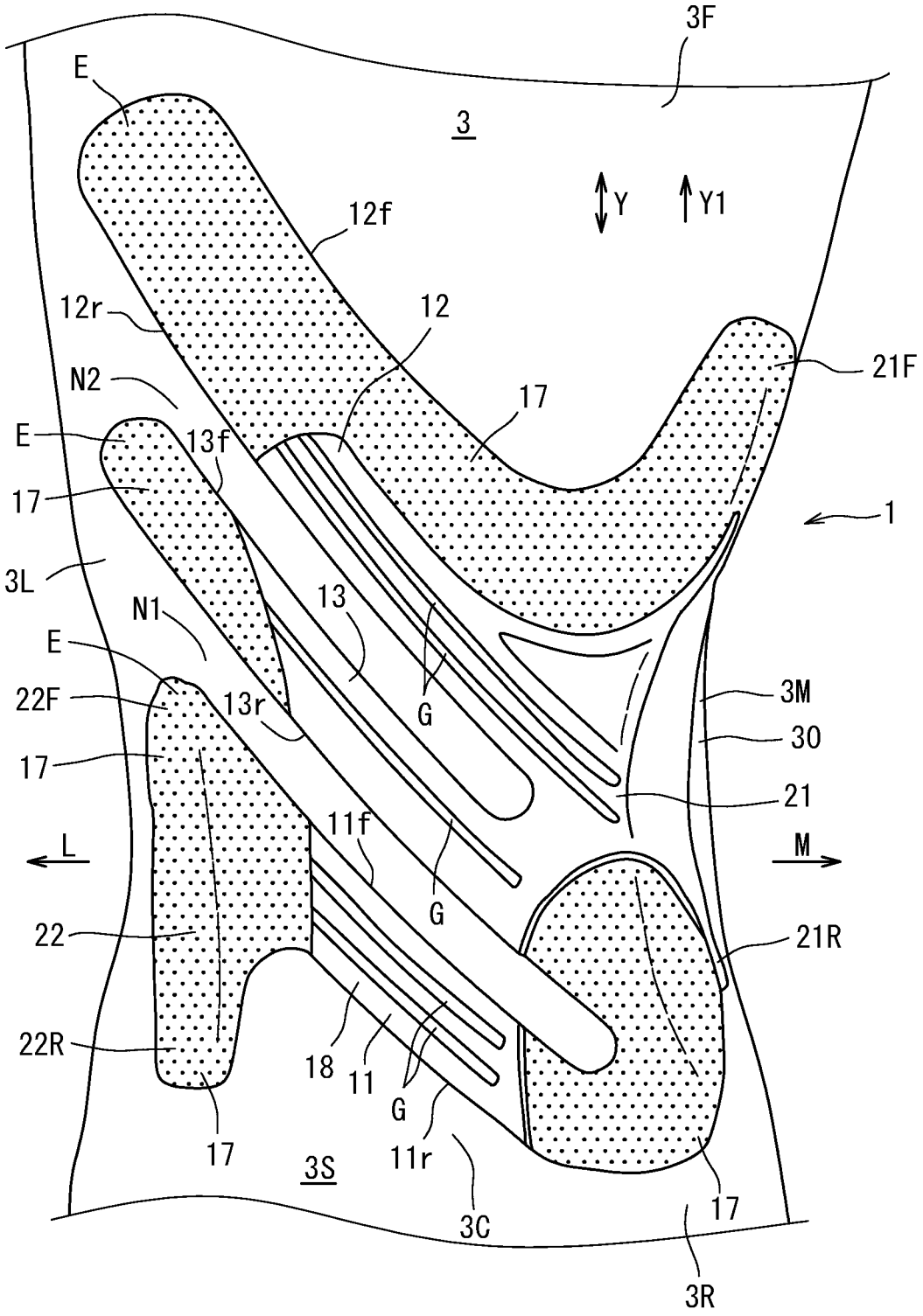
FIG. 8 is an enlarged bottom view showing the same with portions thereof cut away.

In FIG. 8, the second longitudinal portion 22 of this example is shorter than that of Embodiment 1 in the front-rear direction Y. That is, the anterior end portion 22F of the second longitudinal portion 22 is placed posterior to the anterior end portion 21F of the first longitudinal portion 21, and the posterior end portion 22R of the second longitudinal portion 22 is placed anterior to the posterior end portion 21R of the first longitudinal portion 21.

Figure 10:
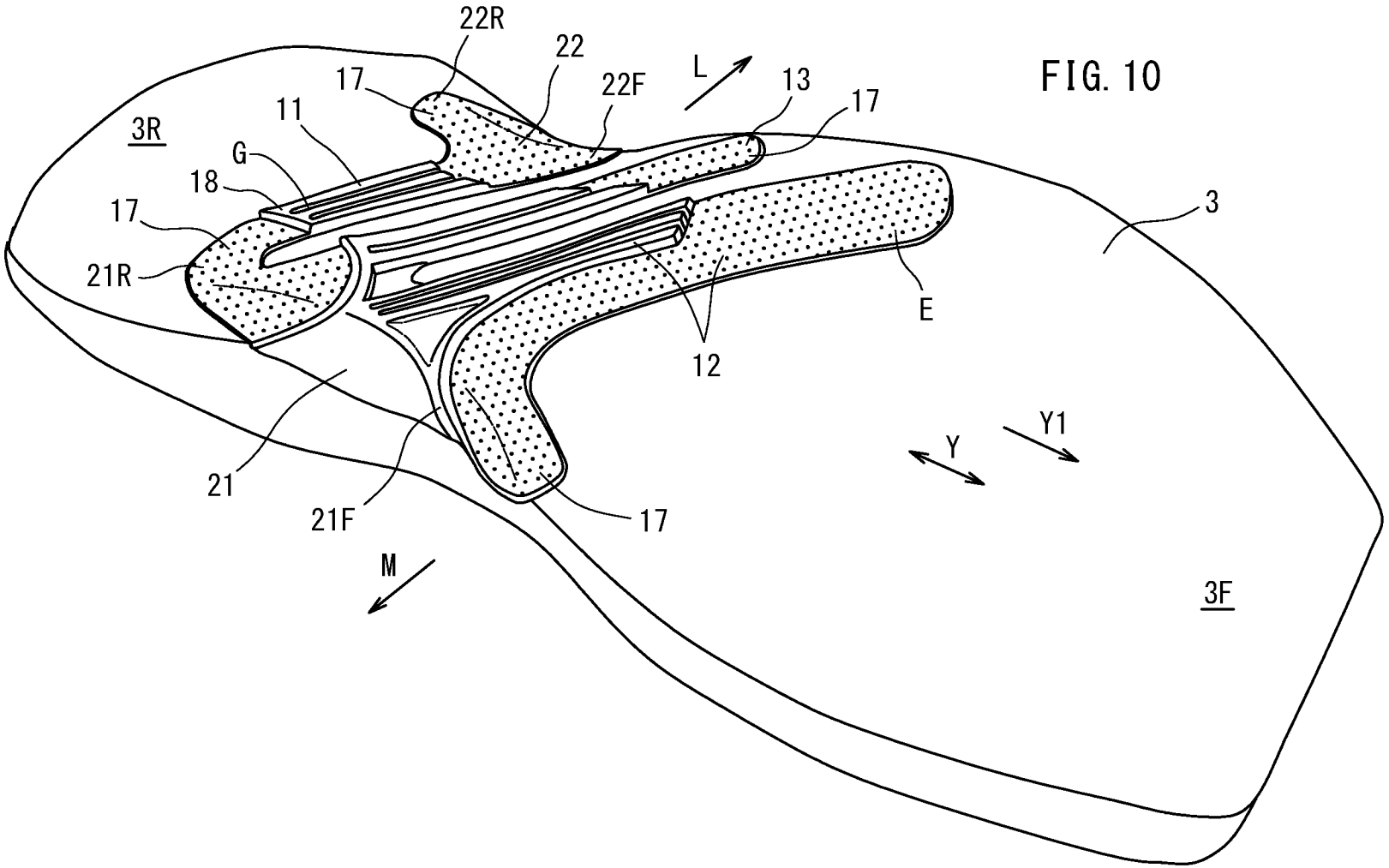
FIG. 10 is a perspective view showing the midsole and the reinforcement device as seen from a diagonal anterior-medial side.
Figure 11:
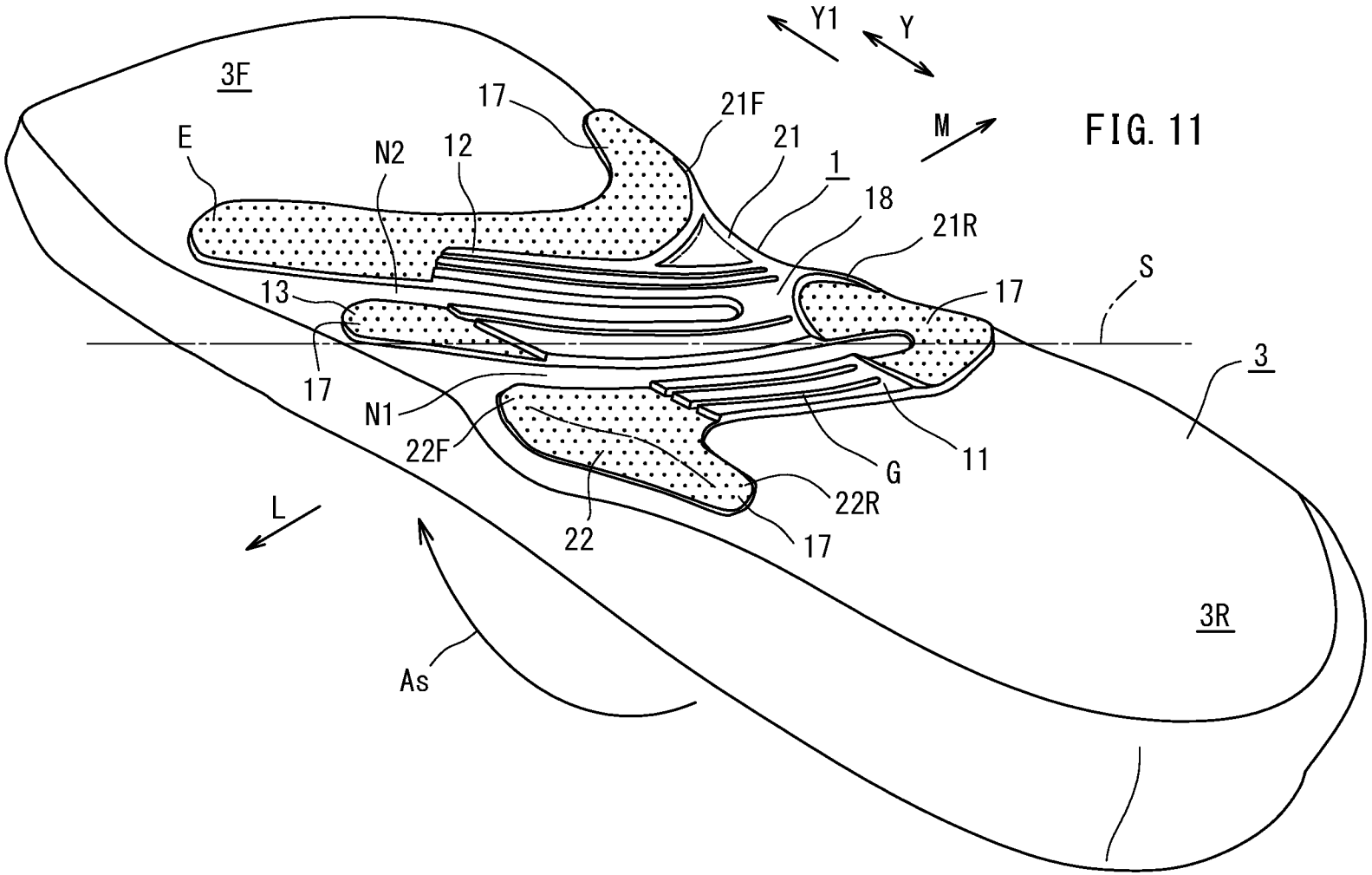
FIG. 11 is a perspective view showing the same as seen from a diagonal posterior-lateral side.

As shown in FIG. 10 and FIG. 11, the bars 11 to 13 are provided with grooves G on the thick portion 18 along the direction in which the bars 11 to 13 extend.

Figure 7:
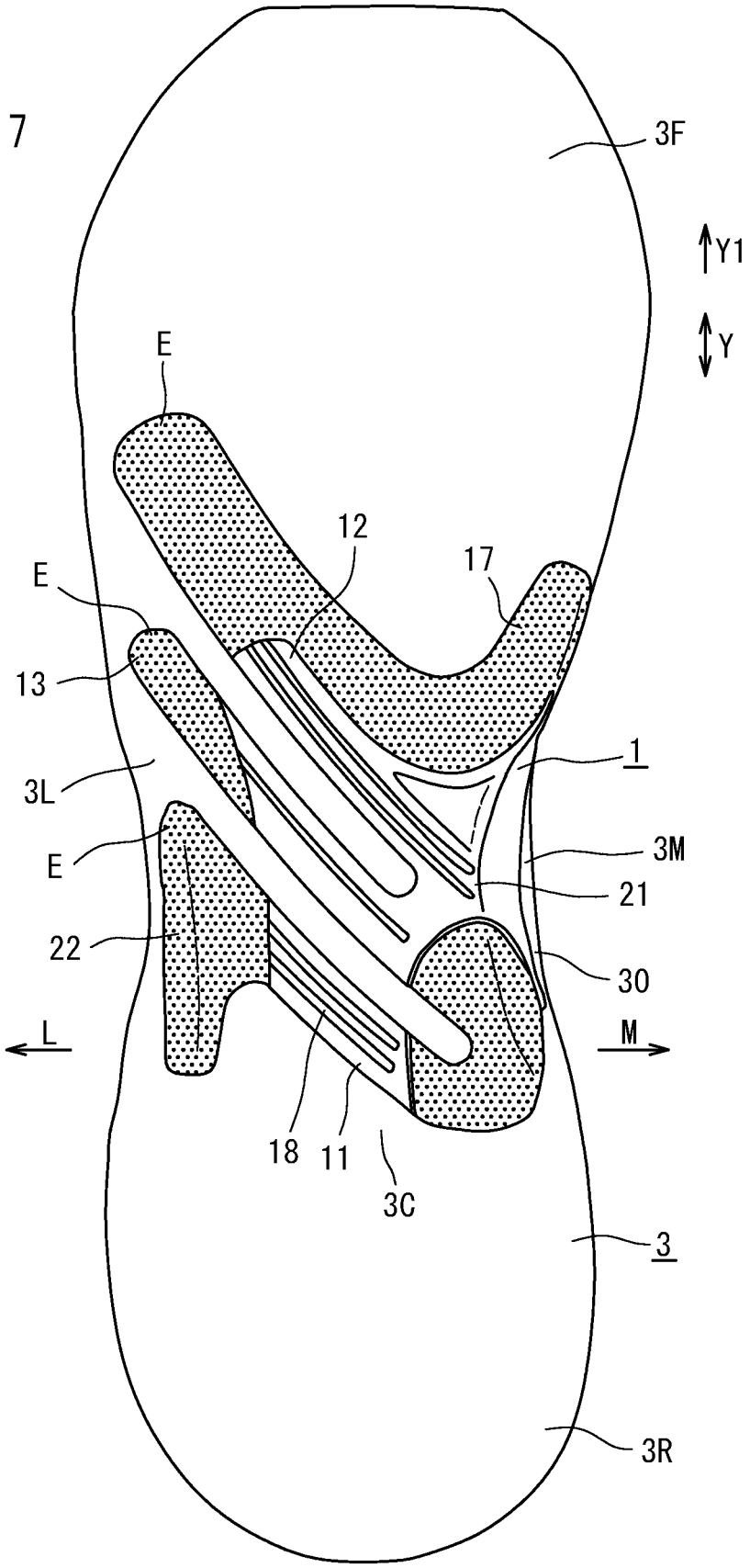
FIG. 7 is a bottom view showing a midsole and a reinforcement device according to Embodiment 2 of the present disclosure.

Note that the inclination of the bars 11 to 13 shown in FIG. 7 is closer to being horizontal than those of Embodiment 1 shown in FIG. 1.

As shown in FIG. 7 to FIG. 11, the entire second longitudinal portion 22 is formed as a thin portion 17. As shown in FIG. 8, the entire second longitudinal portion 22, the distal end portions E the first to third bars 11 to 13, the anterior end portion 21F of the first longitudinal portion 21 and the posterior end portion 21R of the first longitudinal portion 21 are each formed as a thin portion 17, and these portions are sandwiched between the outsole 4 and the midsole 3 as shown in FIG. 12.

Figure 13B:
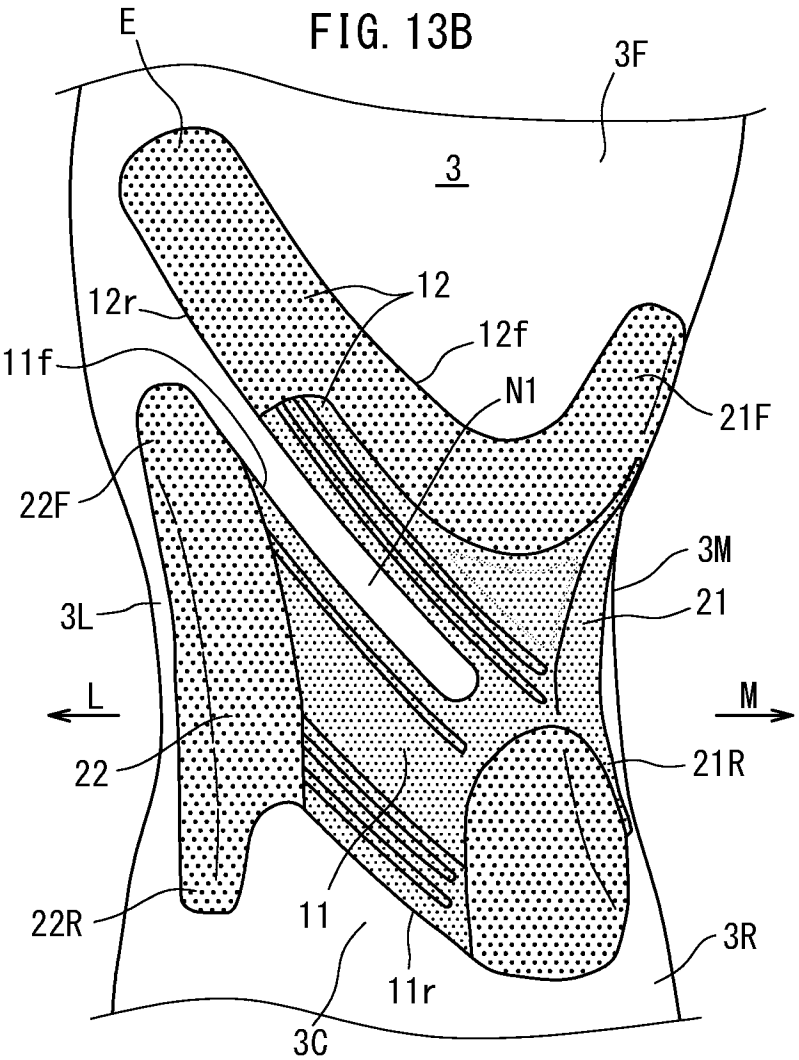
FIG. 13A and FIG. 13B are bottom views respectively showing a portion of a midsole with a reinforcement device according to Embodiment 3 and that according to Embodiment 4.
Figure 13A:
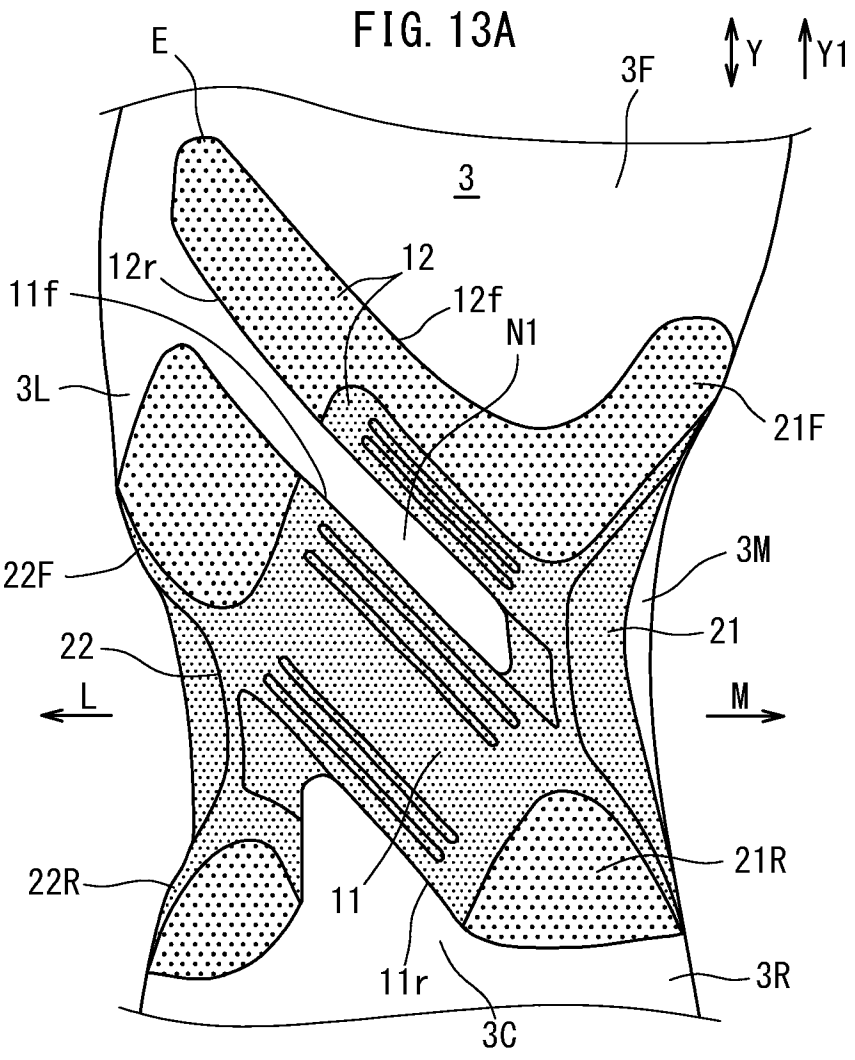

FIG. 13A and FIG. 13B show structures in which the third bars of FIG. 1 and FIG. 7 are formed integral with the first bars 11 of FIG. 13A and FIG. 13B, respectively. The first notch N1 is defined between the posterior edge 12*r* of the second bar 12 and the anterior edge 11*f* of the first bar 11.

Note that another notch (not shown) may be provided in the first bar 11.

Figure 14:
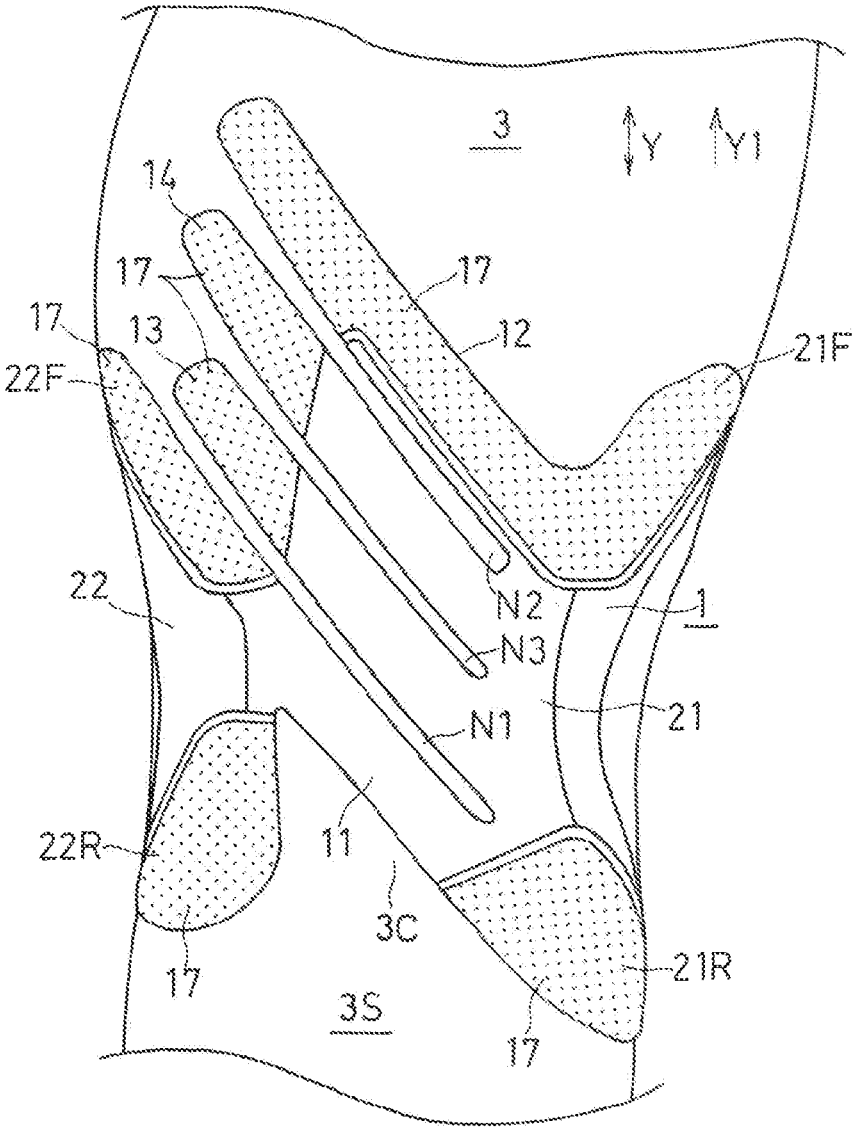
FIG. 14 is a bottom view showing a portion of a midsole with a reinforcement device according to Embodiment 5.
Figure 15:
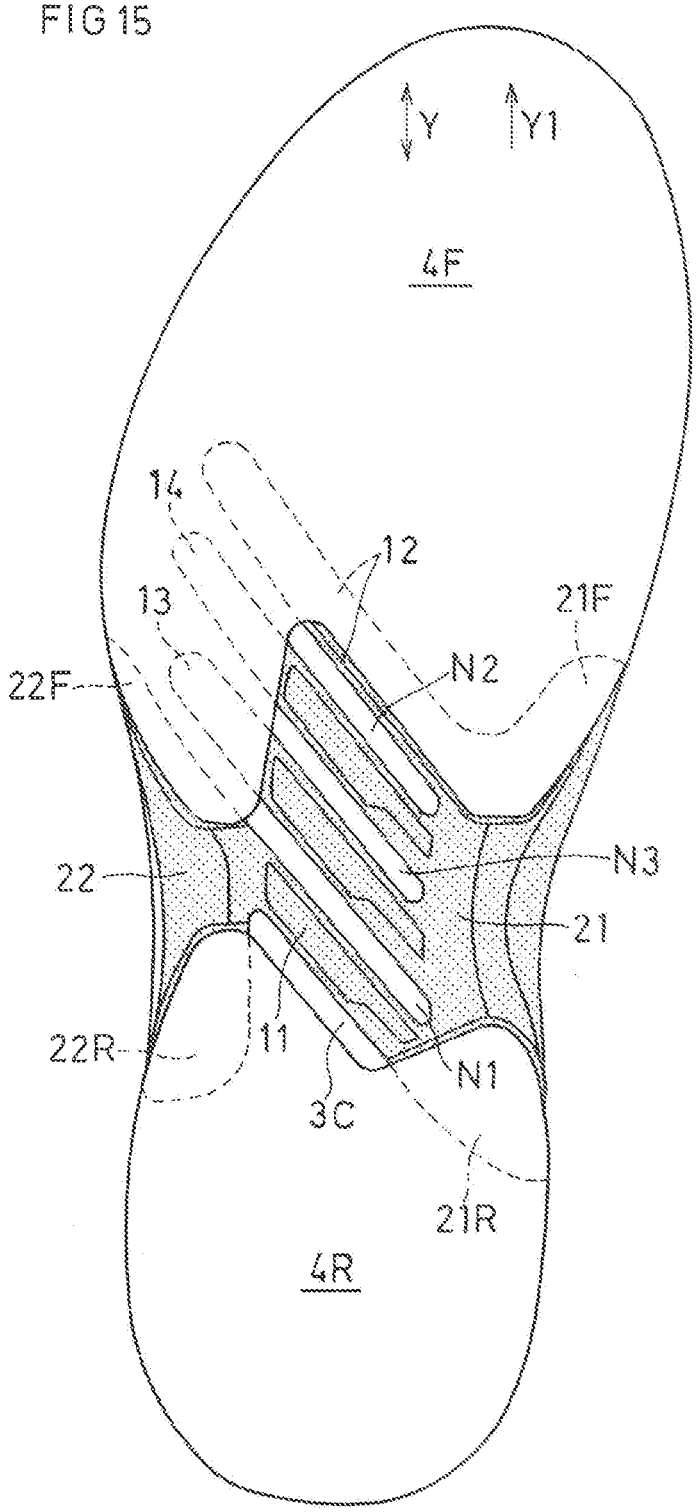
FIG. 15 is a bottom view showing the same shoe sole.

FIG. 14 and FIG. 15 show a case in which there are four bars.

In this example, the first to fourth bars 11 to 14 are provided to be substantially parallel to each other. On the other hand, the first to third notches N1 to N3 are provided to be substantially parallel to each other.

Note that otherwise, the structure of the present embodiment is similar to Embodiment 1.

Other Examples

FIGS. 16A to 16D, and FIGS. 17A to 17E show still other examples.

Figure 16A:
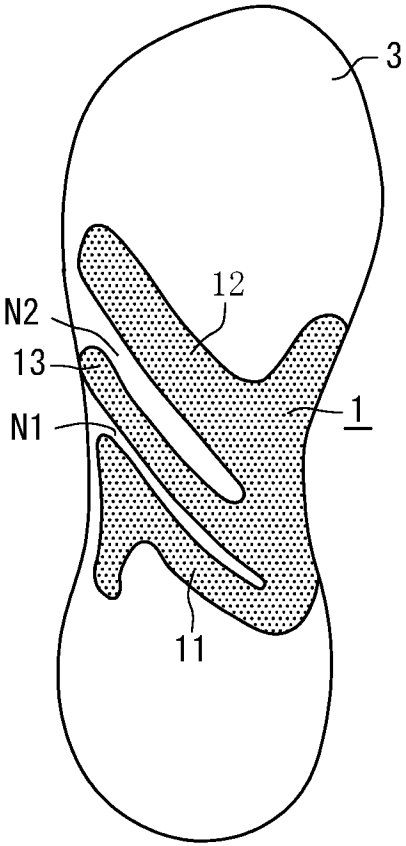
FIGS. 16A to 16D are bottom views each showing a midsole with a reinforcement device, showing another example of a reinforcement device.

As shown in FIG. 16A, the width of the first notch N1 and the width of the second notch N2 may be different from each other.

Figure 16B:
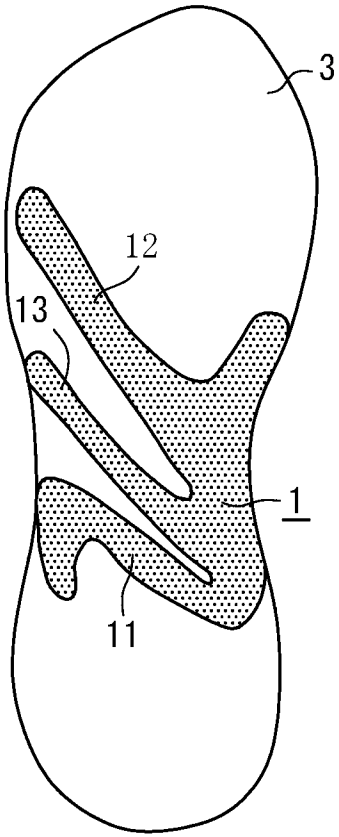

As shown in FIG. 16B, the bars 11 to 13 may extend in slightly different directions.

Figure 16C:
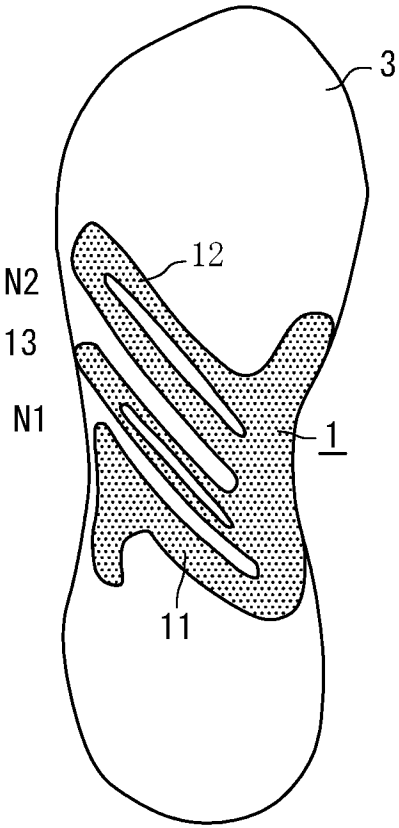

As shown in FIG. 16C, another notch, separate from the first notch N1 and the second notch N2, may be provided in the bars 11 to 13 (e.g., in the second and third bars 12 and 13).

Figure 16D:
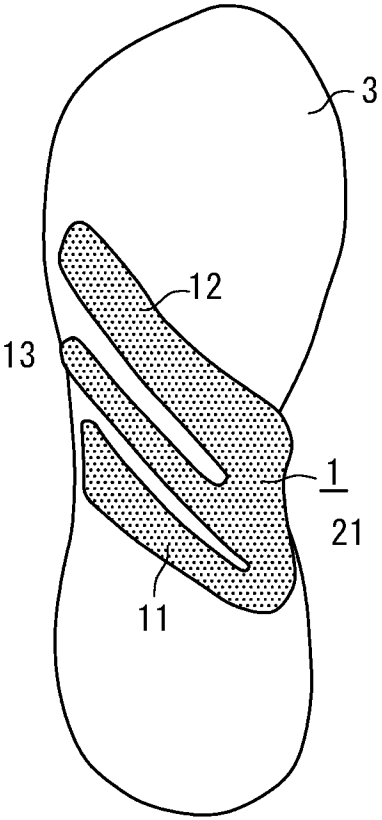

As shown in FIG. 16D, the second longitudinal portion 22 may be absent.

Figure 17A:
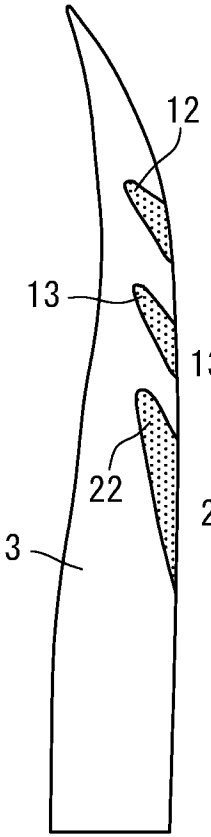
FIGS. 17A, 17B and 17C are a lateral side view, a bottom view and a medial side view, respectively, showing still another example of a midsole with a reinforcement device.
Figure 17B:
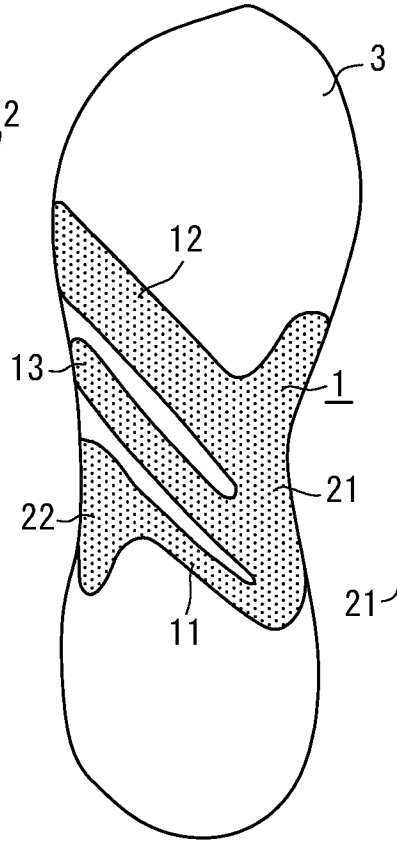
Figure 17C:
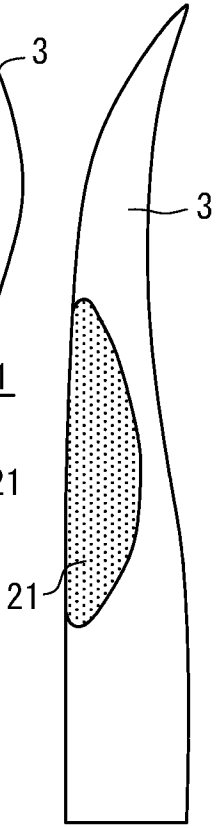

As shown in FIGS. 17A to 17C, the second bar 12, the third bar 13, the first longitudinal portion 21 and the second longitudinal portion 22 may be continuous with the roll-up of the side surface of the midsole 3.

Figure 17D:
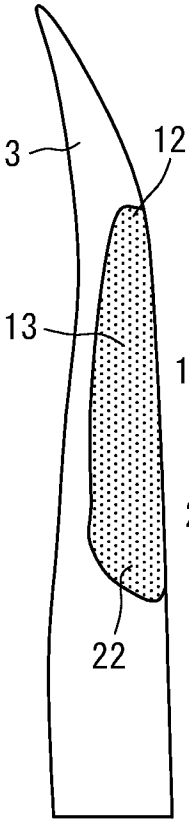
FIGS. 17D and 17E are a lateral side view and a bottom view, respectively, showing still another example.
Figure 17E:
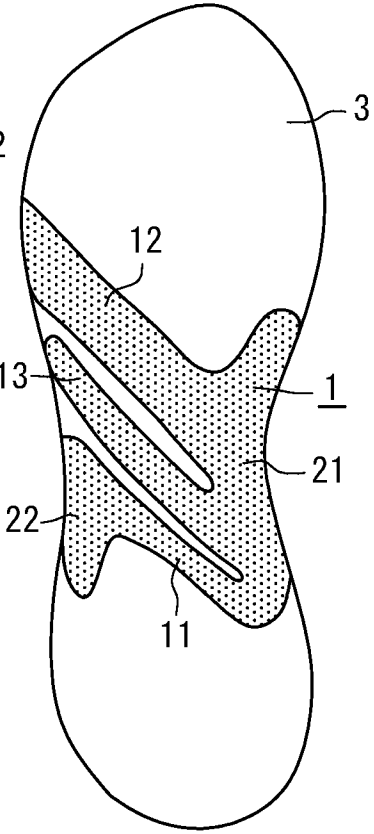

As shown in FIGS. 17D and 17E, the second bar 12, the third bar 13 and the second longitudinal portion 22 may be continuous with each other in the front-rear direction on the roll-up of the side surface of the midsole 3.

While preferred embodiments have been described above with reference to the drawings, various obvious changes and modifications will readily occur to those skilled in the art upon reading the present specification.

For example, the midsole may be provided with a gel or pod-shaped shock-absorbing part. Grooves may be formed only in the outsole.

The number of bars is not limited to two to four, but may be five or more.

Thus, such changes and modifications are deemed to fall within the scope of the present disclosure.

The present embodiments may be applicable not only to shoes for ball sports, but also to various other athletic shoes such as training shoes, fitness shoes and shoes for court sports.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Recitations of Some Embodiments of the Disclosure

1. A shoe sole structure having a reinforcement device 1, the shoe sole structure comprising: an outsole 4 having a tread surface 40 and an upper surface 41 opposite to the tread surface 40; a midsole 3 having a lower surface 3S attached to the upper surface 41 of the outsole 4; and a reinforcement device 1 that is attached to the lower surface 3S of the midsole 3 and that is harder than the midsole 3 and the outsole 4, wherein: the midsole 3 includes a forefoot portion 3F, a middle foot portion 30 and a rear foot portion 3R, and includes a medial edge portion 3M, a lateral edge portion 3L and a central portion 3C between the medial edge portion 3M and the lateral edge portion 3L; the reinforcement device 1 is placed in the middle foot portion 30 so as to extend from the medial edge portion 3M to the lateral edge portion 3L; the reinforcement device 1 includes a first longitudinal portion 21, a first bar 11 and a second bar 12 that are seamlessly integral together, the first longitudinal portion 21 extending in a front-rear direction Y in the medial edge portion 3M of the middle foot portion 30, and the first bar 11 and the second bar 12 being parallel to each other; the first bar 11 extends from a posterior end portion 21R of the first longitudinal portion 21 diagonally across the central portion 3C in a diagonal anterior Y1 direction toward a lateral side L to the lateral edge portion 3L; and the second bar 12 is spaced apart from the first bar, extending from a position that is anterior Y1 to the posterior end portion 21R of the first longitudinal portion 21 diagonally across the central portion 3C in the diagonal anterior direction toward the lateral side L to the lateral edge portion 3L.

2. The shoe sole structure according to Embodiment 1, wherein: the reinforcement device 1 includes a second longitudinal portion 22 that is seamlessly integral with the first bar 11, the second longitudinal portion 22 extending in the front-rear direction Y in the lateral edge portion 3L of the middle foot portion 30; the first bar 11 extends from the posterior end portion 21R of the first longitudinal portion 21 in the diagonal anterior Y1 direction toward the lateral side L to an anterior end portion 22F of the second longitudinal portion 22, thus connecting together the posterior end portion 21R of the first longitudinal portion 21 and the anterior end portion 22F of the second longitudinal portion 22; and the second bar is placed anterior Y1 to the first bar 11.

3. The shoe sole structure according to Embodiment 1 or 2, wherein: the reinforcement device 1 includes a third bar 13 that is seamlessly integral with the first longitudinal portion 21; the third bar 13 is placed between the first bar 11 and the second bar 12; and the third bar 13 is spaced apart from the first and second bars 11 and 12 in the front-rear direction Y, extending from the first longitudinal portion 21 diagonally across the central portion 3C in the diagonal anterior Y1 direction toward the lateral side L to the lateral edge portion 3L.

4. The shoe sole structure according to Embodiment 3, wherein: an anterior edge 11*f* of the first bar 11 and a posterior edge 13*r* of the third bar 13 together define a first notch N1 of the reinforcement device 1, wherein the lower surface 3S of the midsole 3 is exposed through the first notch N1; and a posterior edge 12*r* of the second bar 12 and an anterior edge 13*f* of the third bar 13 together define a second notch N2 of the reinforcement device 1, wherein the lower surface 3S of the midsole 3 is exposed through the second notch N2.

5. The shoe sole structure according to Embodiment 4, wherein the first and second notches N1 and N2 extend diagonally at least across more than half of the central portion 3C, and further extend in the diagonal anterior direction from the central portion 3C to the lateral edge portion 3L.

6. The shoe sole structure according to Embodiment 5, wherein the first and second notches N1 and N2 are each formed in a strip shape and are provided so as to be parallel to each other.

7. The shoe sole structure according to Embodiment 4, wherein a sum of widths of the first to third bars in the central portion 3C is greater than a sum of widths of the first and second notches in the central portion 3C.

8. The shoe sole structure according to Embodiment 4, wherein an average width value between the first to third bars in the central portion 3C is greater than an average width value between the first and second notches in the central portion 3C.

9. The shoe sole structure according to Embodiment 3, wherein: the midsole 3 has an upper surface 31 opposite to the lower surface 3S; and the third bar 13 is formed in an arch shape that is convex toward the upper surface 31 of the midsole 3.

10. The shoe sole structure according to any one of Embodiments 1 to 9, wherein the reinforcement device 1 includes: thin portions 17 sandwiched between the midsole 3 and the outsole 4, the thin portions 17 including distal end portions E of the first, second and third bars, an anterior end portion 21F of the first longitudinal portion 21, and the posterior end portion 21R of the first longitudinal portion 21; and a thick portion 18 exposed on the lower surface 3S of the midsole 3, the thick portion 18 being thicker than the thin portions 17.

11. The shoe sole structure according to Embodiment 10, wherein in the thick portion 18, each of the bars includes a ridge T or a groove G extending along a direction in which the bar extends.

12. The shoe sole structure according to Embodiment 2, wherein a distal end portion E of the second bar 12 is a free end portion that is spaced apart from the first and second longitudinal portions 21 and 22.

13. The shoe sole structure according to Embodiment 1, wherein: the outsole 4 is continuous from a forefoot section to a rear foot section, and includes a cut-out notch portion N in the middle foot portion 30 of the midsole 3; and at least a portion of the first longitudinal portion 21 and at least a portion of the first and second bars 11 and 12 are exposed through the notch portion N.

14. The shoe sole structure according to Embodiment 2, wherein: the outsole 4 is divided in a front-rear direction into an anterior part 4F and a posterior part 4R; and at least a portion of each of the first longitudinal portion 21, the second longitudinal portion 22 and the first and second bars 11 and 12 is exposed between the anterior part 4F and the posterior part 4R of the outsole 4.

15. The shoe sole structure according to Embodiment 1, wherein: an anterior end portion 21F of the first longitudinal portion 21 and the second bar 12 are continuous together in a V-letter shape; and a distal end portion E of the second bar 12 is placed anterior Y1 to the anterior end portion 21F of the first longitudinal portion 21.

What is claimed is:

1. A reinforcement structure disposed on a midsole of a shoe, the reinforcement structure in plan view, comprising:

a first bar extending from a first point in a medial side of the midsole to a second point in the medial side of the midsole, the second point being closer to a toe of the shoe than the first point;

a second bar extending from the first point to a third point in a lateral side of the midsole, the third point being closer to the toe of the shoe than the first point;

a third bar extending from a fourth point in the medial side of the midsole to a fifth point in the lateral side of the midsole, the fourth point being a point between the first point and the second point, the fifth point being closer to the toe of the shoe than the fourth point, the third bar extending further toward the toe of the shoe than the second bar;

a fourth bar extending from the third point to a sixth point in the lateral side of the midsole, the third point being closer to the toe of the shoe than the sixth point, wherein the first bar extends along the first point, the fourth point, and the second point in that order, wherein the first bar and the second bar are connected together at the first point, and the first bar and the third bar connected together at the fourth point, wherein the first bar, the second bar, and the third bar are respective parts of a single piece, and wherein the second bar and third bar are connected together only via the first bar, wherein the second bar and the fourth bar are connected together at the third point, wherein the fourth bar is a part of the single piece including the first bar, the second bar, and the third bar, and wherein the third bar has a free end at the fifth point, the free end of the third bar having no connection to other bars.

2. The reinforcement structure according to claim 1, wherein the midsole has a medial edge on the medial side, and a lateral edge on the lateral side, and the first bar has an outer edge disposed at the medial edge of the midsole, and an inner edge opposite to the outer edge.

3. The reinforcement structure according to claim 1, wherein the midsole has a medial edge on the medial side, and a lateral edge on the lateral side, and the first bar has an outer edge, a shape of which follows a shape of the medial edge of the midsole, and an inner edge opposite to the outer edge.

4. The reinforcement structure according to claim 1, the second and third bars are substantially straight and parallel with each other.

5. The reinforcement structure according to claim 1, wherein a first distance between the first point and the second point is longer than a second distance between the third point and the sixth point.

6. The reinforcement structure according to claim 1, wherein the midsole has a medial edge on the medial side, and a lateral edge on the lateral side, and the fourth bar is disposed closer to the lateral edge of the midsole than a center between the medial edge and the lateral edge.

7. The reinforcement structure according to claim 6, wherein the fourth bar has an outer edge disposed at the lateral edge of the midsole, and an inner edge opposite to the outer edge.

8. The reinforcement structure according to claim 6, wherein the fourth bar has an outer edge, a shape of which follows a shape of the lateral edge of the midsole, and an inner edge opposite to the outer edge.

9. The reinforcement structure according to claim 1, further comprising a fifth bar extending, between the second bar and the third bar, from a seventh point in the medial side of the midsole to an eighth point in the lateral side of the midsole, the seventh point being a point between the first point and the fourth point, the eighth point being closer to the toe of the shoe than the seventh point, wherein the first bar extends along the first point, the seventh point, the fourth point, and the second point in that order, wherein the first bar and the fifth bar are connected together at the seventh point, wherein the fifth bar is a part of the single piece together with the first bar, the second bar, the third bar, and the fourth bar, and wherein the fifth bar is connected to the second bar and the third bar via the first bar only.

10. The reinforcement structure according to claim 9, further comprising:

a first gap between the second bar and the fifth bar from which the midsole is exposed; and a second gap between the fifth bar and the third bar from which the midsole is exposed.

11. The reinforcement structure according to claim 10, wherein a sum of a width of the second bar, a width of the third bar, and a width of the fifth bar is greater than a sum of a width of the first gap and a width of the second gap.

12. The reinforcement structure according to claim 9, wherein the fifth bar has an arched shape toward an inside of the midsole.

13. The reinforcement structure according to claim 1, wherein the second bar has one of a ridge or a groove extending between the first point and the third point, and the third bar has one of a ridge or a groove extending between the fourth point and the fifth point.

14. A shoe sole comprising:

a midsole;

the reinforcement structure, according to claim 1, disposed on the midsole, wherein the reinforcement structure has a first portion and a second portion; and an outsole having a notch, wherein in plan view, the outsole covers the midsole and the second portion of the reinforcement structure, and the notch exposes the first portion of the reinforcement structure.

15. The shoe sole according to claim 14, wherein the first bar, the second bar, and the third bar respectively have portions forming the first portion of the reinforcement structure, the portions having thicknesses thinner than other portions of the first bar, the second bar, and the third bar.

16. A shoe sole comprising:

a midsole having a surface;

the reinforcement structure according to claim 1, disposed on the surface of the midsole; and an outsole partially disposed on the surface of the midsole, wherein the reinforcement structure is partially exposed from an area where no outsole is disposed on the midsole.

17. The reinforcement structure according to claim 1, wherein the third bar extending between the fourth point and the fifth point and a part of the first bar extending between the fourth point and the second point forms a v-shape, and the fifth point is closer to the toe of the shoe than the second point.

* * * * *